US007401419B2

(12) United States Patent
Lucas et al.

(10) Patent No.: US 7,401,419 B2
(45) Date of Patent: Jul. 22, 2008

(54) STRUCTURAL ELEMENT FOR A SHOE SOLE

(75) Inventors: Robert J. Lucas, Lake Oswego, OR (US); Vincent Philippe Rouiller, Collognes ou Mont d'Or (DE); Allen W. Van Noy, Portland, OR (US); Stephen Michael Vincent, Portland, OR (US)

(73) Assignee: adidas International Marketing B.V., Amsterdam (NL)

( * ) Notice: Subject to any disclaimer, the term of this patent is extended or adjusted under 35 U.S.C. 154(b) by 0 days.

(21) Appl. No.: 11/346,998

(22) Filed: Feb. 3, 2006

(65) Prior Publication Data

US 2006/0288612 A1 Dec. 28, 2006

Related U.S. Application Data

(63) Continuation-in-part of application No. 10/619,652, filed on Jul. 15, 2003, now Pat. No. 7,013,582.

(30) Foreign Application Priority Data

| | | |
|---|---|---|
| Jul. 31, 2002 | (DE) | 102 34 913 |
| Mar. 28, 2003 | (EP) | 03006874 |
| Feb. 11, 2005 | (DE) | 10 2005 006 267 |

(51) Int. Cl.
*A43B 13/18* (2006.01)

(52) U.S. Cl. ..... 36/28; 36/27; 36/29

(58) Field of Classification Search ..... 36/27, 36/28, 29, 30 R, 31, 32
See application file for complete search history.

(56) References Cited

U.S. PATENT DOCUMENTS

| | | | |
|---|---|---|---|
| 1,841,942 | A | 1/1932 | Fenton |
| 2,224,590 | A | 12/1940 | Boivin |
| 2,547,480 | A | 4/1951 | McDaniel |
| 2,863,231 | A | 12/1958 | Jones |
| 3,834,046 | A | 9/1974 | Fowler |
| 4,000,566 | A | 1/1977 | Famolare, Jr. |
| D247,267 | S | 2/1978 | Dolinsky |
| 4,083,125 | A | 4/1978 | Benseler et al. |
| 4,130,947 | A | 12/1978 | Denu |
| 4,183,156 | A | 1/1980 | Rudy |
| 4,236,326 | A | 12/1980 | Inohara |
| 4,296,557 | A | 10/1981 | Pajevic |
| 4,297,796 | A | 11/1981 | Stirtz et al. |
| 4,316,332 | A | 2/1982 | Giese et al. |

(Continued)

FOREIGN PATENT DOCUMENTS

| | | |
|---|---|---|
| DE | 41 14 551 | 5/1992 |

(Continued)

*Primary Examiner*—Ted Kavanaugh
(74) *Attorney, Agent, or Firm*—Goodwin Procter LLP

(57) ABSTRACT

The present invention relates to a shoe sole including a cushioning element. The shoe sole can include a heel cup or heel rim having a shape that substantially corresponds to the shape of heel of a foot. Further, the heel part can include a plurality of side walls arranged below the heel cup or rim and at least one tension element that interconnects at least one side wall to another side wall or to the heel cup or rim. The heel cup or rim, the plurality of side walls, and the at least one tension element can be integrally formed as a single piece.

20 Claims, 23 Drawing Sheets

U.S. PATENT DOCUMENTS

| | | | | |
|---|---|---|---|---|
| 4,364,189 | A | 12/1982 | Bates | |
| 4,364,190 | A | 12/1982 | Yonkers | |
| 4,391,048 | A | 7/1983 | Lutz | |
| 4,438,573 | A | 3/1984 | McBarron | |
| 4,451,994 | A | 6/1984 | Fowler | |
| 4,492,046 | A | 1/1985 | Kosova | |
| 4,506,461 | A | 3/1985 | Inohara | |
| 4,507,879 | A | 4/1985 | Dassler | |
| 4,523,393 | A | 6/1985 | Inohara | |
| 4,524,529 | A | 6/1985 | Schaefer | |
| 4,535,553 | A * | 8/1985 | Derderian et al. | 36/28 |
| 4,551,930 | A | 11/1985 | Graham et al. | |
| 4,562,651 | A | 1/1986 | Frederick et al. | |
| 4,566,206 | A | 1/1986 | Weber | |
| 4,592,153 | A | 6/1986 | Jacinto | |
| 4,610,099 | A | 9/1986 | Signori | |
| 4,611,412 | A | 9/1986 | Cohen | |
| 4,617,745 | A | 10/1986 | Batra | |
| 4,654,983 | A | 4/1987 | Graham et al. | |
| 4,676,010 | A | 6/1987 | Cheskin | |
| 4,676,011 | A | 6/1987 | O'Rourke et al. | |
| 4,753,021 | A | 6/1988 | Cohen | |
| 4,754,559 | A | 7/1988 | Cohen | |
| 4,756,095 | A | 7/1988 | Lakic | |
| 4,759,136 | A | 7/1988 | Stewart et al. | |
| 4,774,774 | A | 10/1988 | Allen, Jr. | |
| 4,798,009 | A | 1/1989 | Colonel et al. | |
| 4,817,304 | A * | 4/1989 | Parker et al. | 36/114 |
| 4,864,738 | A | 9/1989 | Horovitz | |
| 4,874,640 | A | 10/1989 | Donzis | |
| 4,876,053 | A | 10/1989 | Norton et al. | |
| 4,881,329 | A | 11/1989 | Crowley | |
| 4,894,934 | A | 1/1990 | Illustrato | |
| 4,905,383 | A | 3/1990 | Beckett et al. | |
| 4,910,884 | A | 3/1990 | Lindh et al. | |
| 4,918,841 | A | 4/1990 | Turner et al. | |
| 4,934,070 | A | 6/1990 | Mauger | |
| 4,947,560 | A | 8/1990 | Fuerst et al. | |
| 4,972,611 | A | 11/1990 | Swartz et al. | |
| 4,999,931 | A | 3/1991 | Vermeulen | |
| 5,014,706 | A | 5/1991 | Philipp | |
| 5,048,203 | A | 9/1991 | Kling | |
| 5,060,401 | A | 10/1991 | Whatley | |
| D324,940 | S | 3/1992 | Claveria | |
| D326,956 | S | 6/1992 | Damianoe et al. | |
| 5,131,173 | A | 7/1992 | Anderie | |
| 5,138,776 | A | 8/1992 | Levin | |
| D330,797 | S | 11/1992 | Lucas | |
| 5,189,816 | A | 3/1993 | Shibata | |
| 5,195,254 | A | 3/1993 | Tyng | |
| D336,561 | S | 6/1993 | Hatfield | |
| 5,224,277 | A | 7/1993 | Sang Do | |
| D343,272 | S | 1/1994 | James | |
| 5,279,051 | A | 1/1994 | Whatley | |
| 5,282,325 | A | 2/1994 | Beyl | |
| D347,105 | S | 5/1994 | Johnson | |
| 5,335,430 | A | 8/1994 | Fiso et al. | |
| 5,337,492 | A | 8/1994 | Anderie et al. | |
| D350,227 | S | 9/1994 | Kilgore | |
| D350,433 | S | 9/1994 | Kilgore | |
| 5,343,639 | A | 9/1994 | Kilgore et al. | |
| D351,057 | S | 10/1994 | Kilgore | |
| 5,353,523 | A | 10/1994 | Kilgore et al. | |
| 5,353,526 | A | 10/1994 | Foley et al. | |
| D352,160 | S | 11/1994 | Kilgore | |
| 5,367,792 | A | 11/1994 | Richard et al. | |
| D354,617 | S | 1/1995 | Kilgore | |
| 5,381,608 | A | 1/1995 | Claveria | |
| 5,396,718 | A | 3/1995 | Schuler et al. | |
| 5,440,826 | A | 8/1995 | Whatley | |
| 5,461,800 | A | 10/1995 | Luthi et al. | |
| 5,469,638 | A | 11/1995 | Crawford, III | |
| 5,469,639 | A | 11/1995 | Sessa | |
| 5,488,786 | A | 2/1996 | Ratay | |
| 5,493,792 | A | 2/1996 | Bates et al. | |
| 5,502,901 | A | 4/1996 | Brown | |
| 5,511,324 | A | 4/1996 | Smith | |
| 5,513,448 | A | 5/1996 | Lyons | |
| 5,544,431 | A | 8/1996 | Dixon | |
| 5,561,920 | A | 10/1996 | Graham et al. | |
| 5,577,334 | A | 11/1996 | Park | |
| D376,471 | S | 12/1996 | Kaline et al. | |
| 5,596,819 | A | 1/1997 | Goldston et al. | |
| 5,598,645 | A | 2/1997 | Kaiser | |
| 5,625,964 | A | 5/1997 | Lyden et al. | |
| 5,628,128 | A | 5/1997 | Miller et al. | |
| 5,671,552 | A | 9/1997 | Pettibone et al. | |
| 5,678,327 | A | 10/1997 | Halberstadt | |
| 5,701,685 | A | 12/1997 | Pezza | |
| 5,701,686 | A | 12/1997 | Herr et al. | |
| 5,706,589 | A | 1/1998 | Marc | |
| 5,718,063 | A | 2/1998 | Yamashita et al. | |
| 5,729,916 | A | 3/1998 | Vorobiev et al. | |
| 5,743,028 | A | 4/1998 | Lombardino | |
| 5,752,329 | A | 5/1998 | Horibata | |
| 5,771,606 | A | 6/1998 | Litchfield et al. | |
| 5,778,560 | A | 7/1998 | Danieli | |
| 5,782,014 | A | 7/1998 | Peterson | |
| 5,797,198 | A | 8/1998 | Pomerantz | |
| 5,797,199 | A | 8/1998 | Miller et al. | |
| 5,806,208 | A | 9/1998 | French | |
| 5,806,209 | A | 9/1998 | Crowley et al. | |
| 5,822,886 | A | 10/1998 | Luthi et al. | |
| 5,852,886 | A | 12/1998 | Slepian et al. | |
| 5,860,225 | A | 1/1999 | O'Dwyer | |
| 5,875,567 | A | 3/1999 | Bayley | |
| 5,875,568 | A | 3/1999 | Lennihan, Jr. | |
| 5,893,219 | A | 4/1999 | Smith et al. | |
| 5,901,467 | A | 5/1999 | Peterson et al. | |
| 5,930,918 | A | 8/1999 | Healy et al. | |
| 5,937,545 | A | 8/1999 | Dyer et al. | |
| 5,987,781 | A | 11/1999 | Pavesi et al. | |
| 5,996,253 | A | 12/1999 | Spector | |
| 5,996,260 | A | 12/1999 | MacNeill | |
| 6,006,449 | A | 12/1999 | Orlowski et al. | |
| 6,009,636 | A | 1/2000 | Wallerstein | |
| 6,023,859 | A | 2/2000 | Burke et al. | |
| 6,029,374 | A | 2/2000 | Herr et al. | |
| 6,055,746 | A | 5/2000 | Lyden et al. | |
| 6,115,942 | A | 9/2000 | Paradis | |
| 6,115,943 | A | 9/2000 | Gyr | |
| 6,115,944 | A | 9/2000 | Lain | |
| 6,115,945 | A | 9/2000 | Ellis, III | |
| 6,127,010 | A | 10/2000 | Rudy | |
| D434,549 | S | 12/2000 | Solaroli | |
| 6,199,302 | B1 | 3/2001 | Kayano | |
| 6,199,303 | B1 | 3/2001 | Luthi et al. | |
| 6,237,251 | B1 | 5/2001 | Litchfield et al. | |
| 6,253,466 | B1 | 7/2001 | Harmon-Weiss et al. | |
| 6,282,814 | B1 | 9/2001 | Krafsur et al. | |
| 6,295,741 | B1 | 10/2001 | Kita | |
| 6,295,744 | B1 | 10/2001 | Ellis, III | |
| D453,989 | S | 3/2002 | Cagner | |
| 6,354,020 | B1 | 3/2002 | Kimball et al. | |
| 6,385,864 | B1 | 5/2002 | Sell, Jr. et al. | |
| 6,401,365 | B2 | 6/2002 | Kita et al. | |
| 6,402,879 | B1 * | 6/2002 | Tawney et al. | 36/29 |
| 6,516,540 | B2 | 2/2003 | Seydel et al. | |
| 6,519,876 | B1 | 2/2003 | Geer et al. | |
| 6,553,692 | B1 | 4/2003 | Chung | |
| 6,598,320 | B2 | 7/2003 | Turner et al. | |
| 6,647,645 | B2 | 11/2003 | Kita | |
| 2001/0042320 | A1 | 11/2001 | Lindqvist et al. | |
| 2002/0007571 | A1 | 1/2002 | Ellis | |

| | | | |
|---|---|---|---|
| 2002/0129516 | A1 | 9/2002 | Lucas et al. |
| 2003/0000108 | A1 | 1/2003 | Kita |
| 2003/0046830 | A1 | 3/2003 | Ellis |
| 2003/0070322 | A1 | 4/2003 | Masseron |
| 2003/0120353 | A1 | 6/2003 | Christensen |
| 2003/0121178 | A1 | 7/2003 | Rennex |
| 2003/0163933 | A1 | 9/2003 | Krafsur et al. |
| 2003/0172549 | A1 | 9/2003 | Soren |
| 2003/0188455 | A1 | 10/2003 | Weaver |
| 2003/0192203 | A1 | 10/2003 | Meschan |
| 2003/0208926 | A1 | 11/2003 | Ellis |
| 2003/0217482 | A1 | 11/2003 | Ellis |
| 2003/0221336 | A1 | 12/2003 | Krstic |
| 2004/0000074 | A1 | 1/2004 | Auger et al. |

FOREIGN PATENT DOCUMENTS

| | | | |
|---|---|---|---|
| EP | 0 299 669 | | 1/1989 |
| EP | 0 192 820 | | 12/1990 |
| EP | 0 359 421 | B1 | 8/1994 |
| EP | 0 694 264 | A2 | 1/1996 |
| EP | 0 752 216 | A2 | 1/1997 |
| EP | 0 815 757 | A2 | 1/1998 |
| EP | 0 877 177 | A2 | 11/1998 |
| EP | 0 916 277 | A1 | 5/1999 |
| EP | 1 118 280 | | 7/2001 |
| WO | 92/08383 | | 5/1992 |
| WO | 99/04662 | | 2/1999 |
| WO | 99/29203 | | 6/1999 |
| WO | 01/17384 | | 3/2001 |
| WO | 95/20333 | | 10/2001 |

* cited by examiner

STRUCTURAL ELEMENT FOR A SHOE SOLE

CROSS-REFERENCE TO RELATED APPLICATION

This application claims priority to and the benefit of, German Patent Application Serial No. 102005006267.9, filed on Feb. 11, 2005, the entire disclosure of which is hereby incorporated by reference herein. This application is also a continuation-in-part of U.S. patent application Ser. No. 10/619,652, filed on Jul. 15, 2003, now U.S. Pat. No. 7,013,582, which is hereby incorporated herein by reference in its entirety, which incorporates by reference, and claims priority to and the benefit of, German patent application serial number 10234913.4-26, filed on Jul. 31, 2002, and European patent application serial number 03006874.6, filed on Mar. 28, 2003.

TECHNICAL FIELD

The present invention relates to a shoe sole, and more particularly a cushioning element for a shoe sole.

BACKGROUND OF THE INVENTION

When shoes, in particular sports shoes, are manufactured, two objectives are to provide a good grip on the ground and to sufficiently cushion the ground reaction forces arising during the step cycle, in order to reduce strain on the muscles and the bones. In traditional shoe manufacturing, the first objective is addressed by the outsole; whereas, for cushioning, a midsole is typically arranged above the outsole. In shoes subjected to greater mechanical loads, the midsole is typically manufactured from continuously foamed ethylene vinyl acetate (EVA).

Detailed research of the biomechanics of a foot during running has shown, however, that a homogeneously shaped midsole is not well suited for the complex processes occurring during the step cycle. The course of motion from ground contact with the heel until push-off with the toe part is a three-dimensional process including a multitude of complex rotating movements of the foot from the lateral side to the medial side and back.

To better control this course of motion, separate cushioning elements have, in the past, been arranged in certain parts of the midsole. The separate cushioning elements selectively influence the course of motion during the various phases of the step cycle. An example of such a sole construction is found in German Patent No. DE 101 12 821, the disclosure of which is hereby incorporated herein by reference in its entirety. The heel area of the shoe disclosed in that document includes several separate deformation elements having different degrees of hardness. During ground contact with the heel, the deformation elements bring the foot into a correct position for the subsequent rolling-off and pushing-off phases. Typically, the deformation elements are made from foamed materials such as EVA or polyurethane (PU).

Although foamed materials are generally well suited for use in midsoles, it has been found that they cause considerable problems in certain situations. For example, a general shortcoming, and a particular disadvantage for running shoes, is the comparatively high weight of the dense foams.

A further disadvantage is the low temperature properties of the foamed materials. One may run or jog during every season of the year. However, the elastic recovery of foamed materials decreases substantially at temperatures below freezing, as exemplified by the dashed line in the hysteresis graph of FIG. 19C, which depicts the compression behavior of a foamed deformation element at −25° C. As can be seen, the foamed deformation element loses to a great extent its elastic recovery and, as represented by the arrow 9 in FIG. 19C, partly remains in a compressed state even after the external force has been completely removed. Similar effects, as well as an accelerated wear of the foamed materials, are also observed at higher temperatures.

Additionally, where foamed materials are used, the ability to achieve certain deformation properties is very limited. The thickness of the foamed materials is, typically, determined by the dimensions of the shoe sole and is not, therefore, variable. As such, the type of foamed material used is the only parameter that may be varied to yield a softer or harder cushioning, as desired.

Accordingly, foamed materials in the midsole have, in some cases, been replaced by other elastically deformable structures. For example, U.S. Pat. Nos. 4,611,412 and 4,753,021, the disclosures of which are hereby incorporated herein by reference in their entirety, disclose ribs that run in parallel. The ribs are optionally interconnected by elastic bridging elements. The bridging elements are thinner than the ribs themselves so that they may be elastically stretched when the ribs are deflected. Further examples may be found in European Patents Nos. EP 0 558 541, EP 0 694 264, and EP 0 741 529, U.S. Pat. Nos. 5,461,800 and 5,822,886, and U.S. Design Pat. No. 376,471, all the disclosures of which are also hereby incorporated herein by reference in their entirety.

These constructions for the replacement of the foamed materials are not, however, generally accepted. They do not, for instance, demonstrate the advantageous properties of foamed materials at normal temperatures, such as, for example, good cushioning, comfort for the wearer resulting therefrom, and durability.

It is, therefore, an object of the present invention to provide a shoe sole that overcomes both the disadvantages present in shoe soles having foamed materials and the disadvantages present in shoe soles having other elastically deformable structures.

SUMMARY OF THE INVENTION

The present invention includes a shoe sole with a structural heel part. The heel part includes a heel cup or a heel rim having a shape that substantially corresponds to the shape of a heel of a foot. The heel part further includes a plurality of side walls arranged below the heel cup or the heel rim and at least one tension element interconnecting at least one of the side walls with another side wall or with the heel cup or the heel rim. The load of the first ground contact of a step cycle is effectively cushioned not only by the elastically bending stiffness of the side walls, but also by the elastic stretchability of the tension element, which acts against a bending of the side walls.

With the aforementioned components provided as a single piece of unitary construction, a high degree of structural stability is obtained and the heel is securely guided during a deformation movement of the heel part. Accordingly, there is a controlled cushioning movement so that injuries in the foot or the knee resulting from extensive pronation or supination are avoided. Furthermore, a single piece construction in accordance with one embodiment of the invention facilitates a very cost-efficient manufacture, for example by injection molding a single component using one or more suitable plastic materials. Tests have shown that a heel part in accordance with the invention has a lifetime of up to four times longer than heel constructions made from foamed cushioning elements. Furthermore, changing the material properties of the tension element facilitates an easy modification of the dynamic response properties of the heel part to ground reaction forces. The requirements of different kinds of sports or of special requirements of certain users can, therefore, be easily complied with by means of a shoe sole in accordance with the invention. This is particularly true for the production of the single piece component by injection molding, since only a single injection molding mold has to be used for shoe soles with different properties.

In one aspect, the invention relates to a sole for an article of footwear, where the sole includes a heel part. The heel part includes a heel cup having a shape that corresponds substantially to a heel of a foot, a plurality of side walls arranged below the heel cup, and at least one tension element interconnecting at least one side wall with at least one of another side wall and the heel cup. The plurality of side walls can include a rear side wall and at least one other side wall that form an aperture therebetween. The heel cup, the plurality of side walls, and the at least one tension element can be integrally made as a single piece.

In another aspect, the invention relates to an article of footwear including an upper and a sole. The sole includes a heel part. The heel part includes a heel cup having a shape that corresponds substantially to a heel of a foot, a plurality of side walls arranged below the heel cup, and at least one tension element interconnecting at least one side wall with at least one of another side wall and the heel cup. The plurality of side walls can include a rear side wall and at least one other side wall forming an aperture therebetween. The heel cup, the plurality of side walls, and the at least one tension element can be integrally made as a single piece. The sole can include a midsole and an outsole, and the heel part can form a portion of the midsole and/or the outsole.

In various embodiments of the foregoing aspects of the invention, the heel part includes side walls interconnected by the tension element. At least one of the side walls defines one or more apertures therethrough. The size and the arrangement of the aperture(s) can influence the cushioning properties of the heel part during a first ground contact. Besides being an adaptation of the cushioning properties, weight can be reduced. The exact arrangement of the apertures and the design of the side walls and of the other elements of the heel part can be optimized, for example, with a finite-element model. In addition, the heel part can define one or more apertures therethrough, the size and arrangement of which can be selected to suit a particular application. In one embodiment, the heel part is a heel rim including a generally centrally located aperture. Additionally, a skin can at least partially cover or span any of the apertures. The skin can be used to keep dirt, moisture, and the like out of the cavities formed within the heel part and does not impact the structural response of the side walls. The side walls continue to function structurally as separate independent walls.

In one embodiment, the heel part includes a lateral side wall and a medial side wall that are interconnected by the tension element. As a result, a pressure load on the two side walls from above is transformed into a tension load on the tension element. Alternatively or additionally, the tension element can interconnect all of the side walls, including the rear wall. The at least one side wall can include an outwardly directed curvature. The tension element can engage at least two of the plurality of side walls substantially at a central region of the respective side walls. The tension element can extend below the heel cup and be connected to a lower surface of the heel cup at a central region thereof. This additional connection further increases the stability of the single piece heel part.

Further, the heel part can include a substantially horizontal ground surface that interconnects the lower edges of at least two of the plurality of side walls. In one embodiment, an outer perimeter of the horizontal ground surface extends beyond lower edges of the side walls. The horizontal ground surface is generally planar; however, the ground surface can be curved or angled to suit a particular application. For example, the horizontal ground surface can be angled about its outside perimeter or can be grooved along its central region to interact with other components. Additionally, the heel part can include at least one reinforcing element. In one embodiment, the at least one reinforcing element extends in an inclined direction from the horizontal ground surface to at least one of the plurality of the side walls. The at least one reinforcing element can extend from a central region of the horizontal ground surface to at least one of the plurality of side walls. In various embodiments, the at least one reinforcing element and the tension element substantially coterminate at the side wall at, for example, a central region thereof. In one embodiment, the heel part has a symmetrical arrangement of two reinforcing elements extending from a central region of the ground surface to the side walls, wherein the two reinforcing elements each terminate in the same, or substantially the same, area as the tension element. As a result, the single piece heel part has an overall framework-like structure leading to a high stability under compression and shearing movements of the sole.

Furthermore, at least one of the heel cup, the side walls, the tension element, and the reinforcing elements has a different thickness than at least one of the heel cup, the side walls, the tension element, and the reinforcing elements. In one embodiment, a thickness of at least one of the heel cup, the side walls, the tension element, and the reinforcing elements varies within at least one of the heel cup, the side walls, the tension element, and the reinforcing elements. For example, the cushioning behavior of the heel part may be further adapted by side walls of different thicknesses and by changing the curvature of the side walls. Additionally or alternatively, the use of different materials, for example materials of different hardnesses, can be used to further adapt the cushioning properties of the heel part. The heel part can be manufactured by injection molding a thermoplastic urethane or similar material. In one embodiment, the heel part can be manufactured by multi-component injection molding at least two different materials. The heel part can be substantially or completely free from foamed materials, insofar as no purposeful foaming of the material(s) used in forming the heel part is carried out by, for example, the introduction of a chemical or physical process to cause the material to foam. Alternatively, foamed materials can be disposed within the various cavities defined within the heel part by the side walls, tension elements, and reinforcing elements, to improve the cushioning properties of the heel part.

The present invention also relates to a shoe sole, in particular for a sports shoe, having a first area with a first deformation element and a second area with a second deformation element. The first deformation element includes a foamed material and the second deformation element has an open-walled or honeycomb-like structure that is free of foamed materials.

Combining first deformation elements having foamed materials in a first sole area with second deformation elements having open-walled or honeycomb-like structures that are free of foamed materials in a second sole area harnesses the advantages of the two aforementioned construction options for a shoe sole and eliminates their disadvantages. The foamed materials provide an optimally even deformation behavior when the ground is contacted with the shoe sole of the invention and the second deformation elements simultaneously ensure a minimum elasticity, even at extremely low temperatures.

In one aspect, the invention relates to a sole for an article of footwear. The sole includes a first area having a first deformation element that includes a foamed material and a second area having a second deformation element that includes an open-walled or honeycomb-like structure that is free from foamed materials.

In another aspect, the invention relates to an article of footwear that includes an upper and a sole. The sole includes a first area having a first deformation element that includes a foamed material and a second area having a second deformation element that includes an open-walled or honeycomb-like structure that is free from foamed materials.

In various embodiments of the foregoing aspects of the invention, the second deformation element further includes at least two side walls and at least one tension element interconnecting the side walls. The side walls and the tension element may form a single integral piece that may be made from a thermoplastic material, such as, for example, a thermoplastic polyurethane. In one embodiment, the thermoplastic material has a hardness between about 70 Shore A and about 85 Shore A. In one particular embodiment, the hardness of the thermoplastic material is between about 75 Shore A and about 80 Shore A.

In another embodiment, at least one of the tension element and the side walls has a thickness from about 1.5 mm to about 5 mm. Moreover, a thickness of at least one of the tension element and the side walls may increase along a length of the second deformation element. In yet another embodiment, the side walls are further interconnected by at least one of an upper side and a lower side.

In still other embodiments, the sole includes two second deformation elements arranged adjacent each other. At least one of an upper side and a lower side may interconnect adjacent side walls of the two second deformation elements. The two second deformation elements may be further interconnected by at least one of an upper connecting surface and a lower connecting surface. The connecting surface may include a three-dimensional shape for adaptation to additional sole components.

In further embodiments, the tension element interconnects center regions of the side walls. At least one of the side walls may also have a non-linear configuration. In additional embodiments, the first area is arranged in an aft portion of a heel region of the sole and the second area is arranged in a front portion of the heel region of the sole. In other embodiments, the first area is arranged to correspond generally to metatarsal heads of a wearer's foot and the second area is arranged fore of and/or aft of the metatarsal heads of the wearer's foot.

In still other embodiments, the first deformation element includes at least one horizontally extending indentation. Additionally, the first deformation element and the second deformation element may be arranged below at least a portion of at least one load distribution plate of the sole. The load distribution plate may at least partially three-dimensionally encompass at least one of the first deformation element and the second deformation element. Further, in one embodiment, the first deformation element includes a shell defining a cavity at least partially filled with the foamed material. The shell may include a thermoplastic material, such as, for example, a thermoplastic urethane, and the foamed material may include a polyurethane foam. Moreover, the shell may include a varying wall thickness.

In another embodiment, the first deformation element is arranged at least partially in a rearmost portion of the sole and the cavity includes a lateral chamber and a medial chamber. In one embodiment, the lateral chamber is larger than the medial chamber. A bridging passage, which, in one embodiment, is filled with the foamed material, may interconnect the lateral chamber and the medial chamber. In a further embodiment, the shell defines a recess open to an outside and the recess is arranged between the lateral chamber and the medial chamber.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

In the following, embodiments of the sole and the heel part in accordance with the invention are further described with reference to a shoe sole for a sports shoe. It is, however, to be understood that the present invention can also be used for other types of shoes that are intended to have good cushioning properties, a low weight, and a long lifetime. In addition, the present invention can also be used in other areas of a sole, instead of or in addition to the heel area.

Figure 1A:
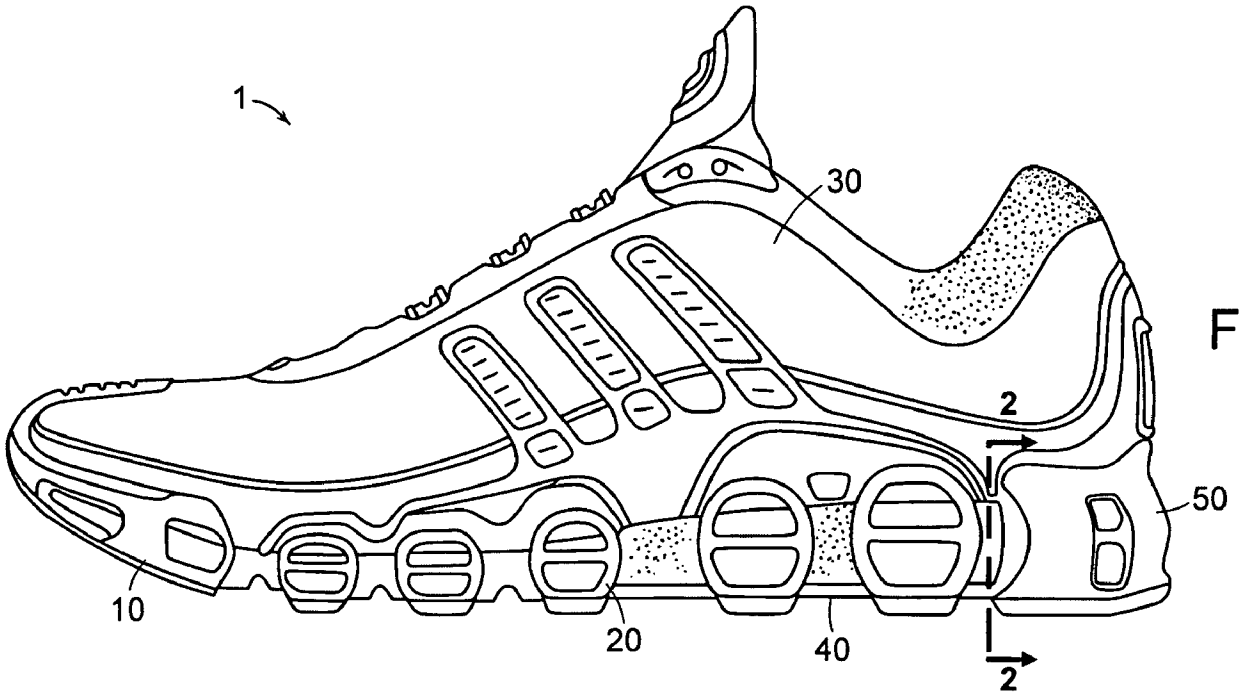
FIG. 1A is a schematic side view of a shoe including a sole in accordance with one embodiment of the invention.

FIG. 1A shows a side view of a shoe 1 including a sole 10 that is substantially free of foamed cushioning elements and an upper 30. As can be seen, individual cushioning elements 20 of a honeycomb-like shape are arranged along a length of the sole 10 providing the cushioning and guidance functions that are in common sports shoes provided by a foamed EVA midsole. The upper sides of the individual cushioning elements 20 can be attached to either the lower side of the upper 30 or to a load distribution plate (or other transitional plate) that is arranged between the shoe upper 30 and the cushioning elements 20, for example by gluing, welding, or other mechanical or chemical means known to a person of skill in the art. Alternatively, the individual cushioning elements 20 could be manufactured integrally with, for example, the load distribution plate.

The lower sides of the individual cushioning elements 20 are in a similar manner connected to a continuous outsole 40. Instead of the continuous outsole 40 shown in FIG. 1B, each cushioning element 20 could have a separate outsole section or sections for engaging the ground. In one embodiment, the cushioning elements 20 are structural elements, as disclosed in U.S. Patent Publication No. 2004/0049946 A1, the entire disclosure of which is hereby incorporated herein by reference.

Figure 1B:
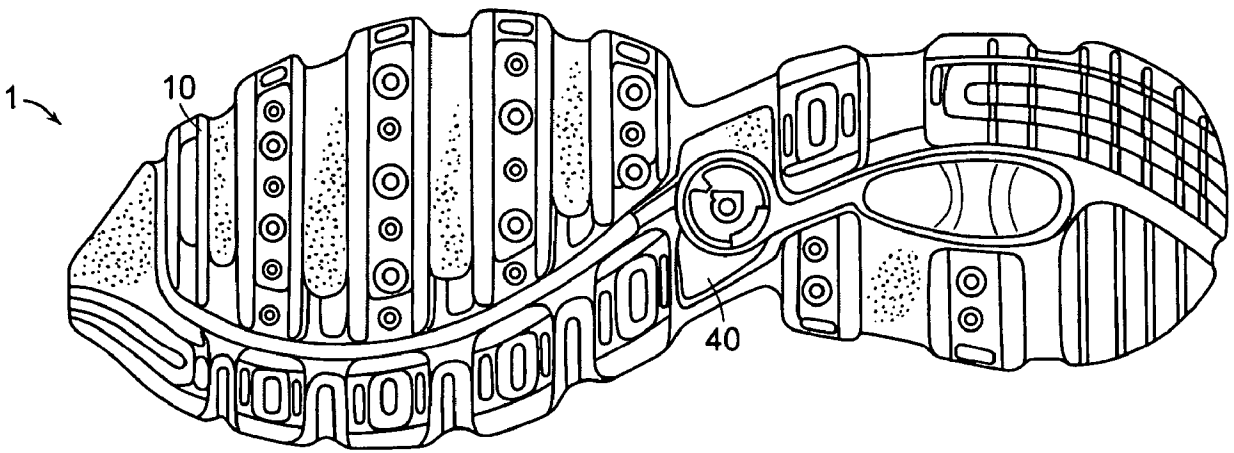
FIG. 1B is a schematic bottom view of the shoe sole of FIG. 1A.

The sole construction presented in FIGS. 1A and 1B is subjected to the greatest loads during the first ground contact of each step cycle. The majority of runners contact the ground at first with the heel before rolling off via the midfoot section and pushing off with the forefoot part. A heel part 50 of the foam-free sole 10 of FIG. 1A is, therefore, subjected to the greatest loads.

FIGS. 2-6 show detailed representations of one embodiment of the heel part 50. The heel part 50, as it is described in detail in the following, can be used independently from the other structural designs of the shoe sole 10. It may, for example, be used in shoe soles wherein one or more commonly foamed cushioning elements are used, instead of or in combination with the above discussed cushioning elements 20.

Figure 2:
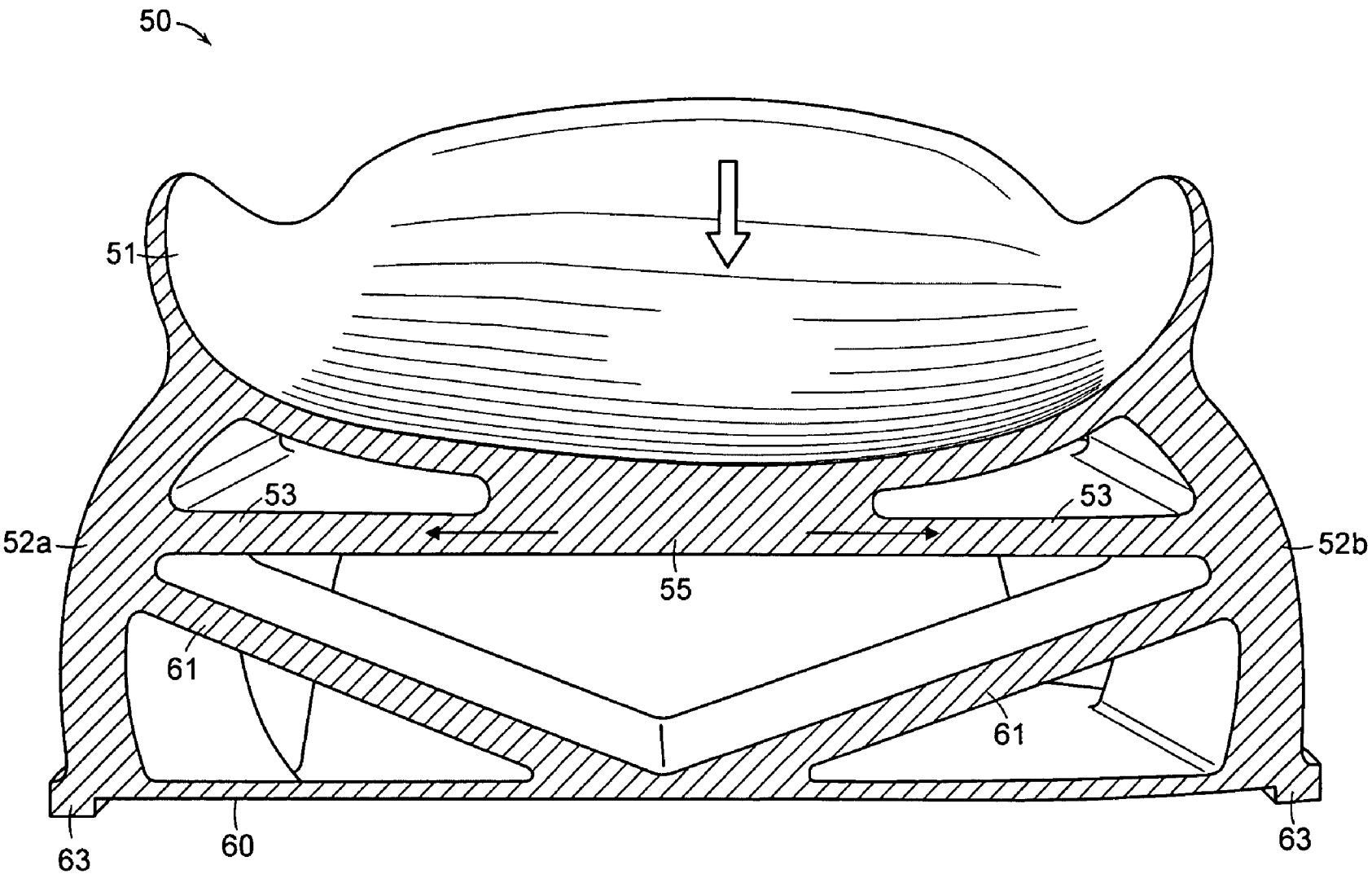
FIG. 2 is a schematic front view of a heel part in accordance with one embodiment of the invention for use in the shoe sole of FIGS. 1A and 1B, orientated as shown by line 2-2 in FIG. 1A.

As shown in FIG. 2, the heel part 50 includes two substantially vertically extending sidewalls 52 arranged below an anatomically shaped heel cup 51 that is adapted to encompasses a wearer's heel from below, on the medial side, the lateral side, and the rear. One of the side walls 52 extends on the medial side and the other on the lateral side. In one embodiment, the sidewalls are separated by an aperture 72 (see FIG. 3) disposed therebetween that allows the side walls to function separately. In a particular embodiment, the sidewalls 52 have an initial unloaded configuration within the heel part 50 of being slightly curved to the outside, i.e., they are convex when viewed externally. This curvature is further increased, when the overall heel part 50 is compressed. The heel part 50 also includes reinforcing elements 61 described in greater detail hereinbelow.

A tension element 53 having an approximately horizontal surface is arranged below the heel cup 51 and extends from substantially a center region of the medial side wall 52*a* to substantially a center region of the lateral side wall 52*b*. Under a load on the heel part 50 (vertical arrow in FIG. 2), the tension element 53 is subjected to tension (horizontal arrows in FIG. 2) when the two side walls 52 are curved in an outward direction. As a result, the dynamic response properties of the heel part 50, for example during ground contact with the sole 10, is in a first approximation determined by the combination of the bending stiffness of the side walls 52 and the stretchability of the tension element 53. For example, a thicker tension element 53 and/or a tension element 53, which due to the material used requires a greater force for stretching, lead to harder or stiffer cushioning properties of the heel part 50.

Both the tension element 53 and the reinforcing elements 61 (explained further below), as well as the side walls 52 and further constructive components of the heel part 50 are provided in one embodiment as generally planar elements. Such a design, however, is not required. On the contrary, it is well within the scope of the invention to provide one or more of the elements in another design, for example, as a tension strut or the like.

In the embodiment depicted, the tension element 53 is interconnected with each side wall 52 at approximately a central point of the side wall's curvature. Without the tension element 53, the maximum bulging to the exterior would occur here during loading of the heel part 50, so that the tension element 53 is most effective here. The thickness of the planar tension element 53, which is generally within a range of about 5 mm to about 10 mm, gradually increases towards the side walls. In one embodiment, the thickness increases by approximately 5% to 15%. In one embodiment, the tension element 53 has the smallest thickness in its center region between the two side walls. Increasing the thickness of the tension element 53 at the interconnections between the tension element 53 and the side walls 52 reduces the danger of material failure at these locations.

In the embodiment shown in FIG. 2, the tension element 53 and a lower surface of the heel cup 51 are optionally interconnected in a central region 55. This interconnection improves the stability of the overall heel part 50. In particular, in the case of shearing loads on the heel part 50, as they occur during sudden changes of the running direction (for example in sports like basketball), an interconnection of the heel cup 51 and the tension element 53 is found to be advantageous. Another embodiment, which is in particular suitable for a basketball shoe, is further described hereinbelow with reference to FIGS. 11A and 11B.

Figure 3:
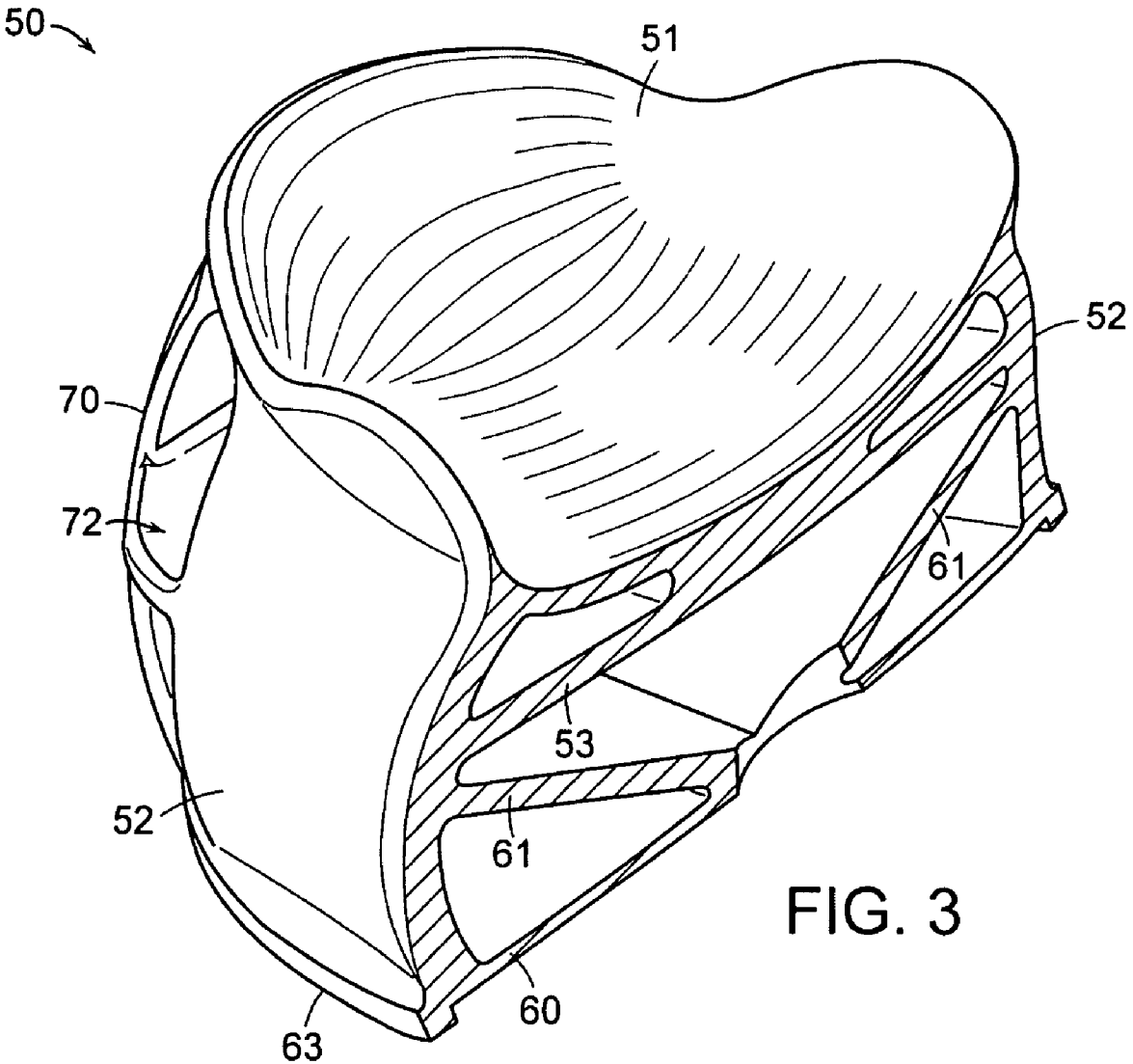
FIG. 3 is a schematic front perspective view of the heel part of FIG. 2.

FIGS. 2 and 3 disclose additional surfaces that form a framework below the heel cup 51 for stabilizing the heel part 50. A ground surface 60 interconnects lower edges of the medial side wall 52*a* and the lateral side wall 52*b*. Together with the heel cup 51 at the upper edges and the tension element 53 in the center, the ground surface 60 defines the configuration of the medial and the lateral side walls 52. Thus, it additionally contributes to avoiding a collapse of the heel part 50 in the case of peak loads, such as when landing after a high leap. Furthermore, additional sole layers can be attached to the ground surface 60, for example the outsole layer 40 shown in FIGS. 1A and 1B, or additional cushioning layers. Such further cushioning layers may be arranged alternatively or additionally above or within the heel part 50.

The ground surface 60 of the single piece heel part 50 may itself function as an outsole and include a suitable profile, such as a tread. This may be desirable if a particularly lightweight shoe is to be provided. As shown in FIGS. 2 and 3, an outer perimeter 63 of the ground surface 60 exceeds the lower edges of the side walls 52. Such an arrangement may be desirable if, for example, a wider region for ground contact is to be provided for a comparatively narrow shoe.

In addition, FIGS. 2 and 3 depict two reinforcing elements 61 extending from approximately the center of the ground surface 60 in an outward and inclined direction to the side walls 52. The reinforcing elements 61 engage the side walls 52 directly below the tension element 53. The reinforcing elements 61 thereby additionally stabilize the deformation of the side walls 52 under a pressure load on the heel part 50. Studies with finite-element-analysis have in addition shown that the reinforcing elements 61 significantly stabilize the heel part 50 when it is subjected to the above mentioned shear loads.

Figure 4:
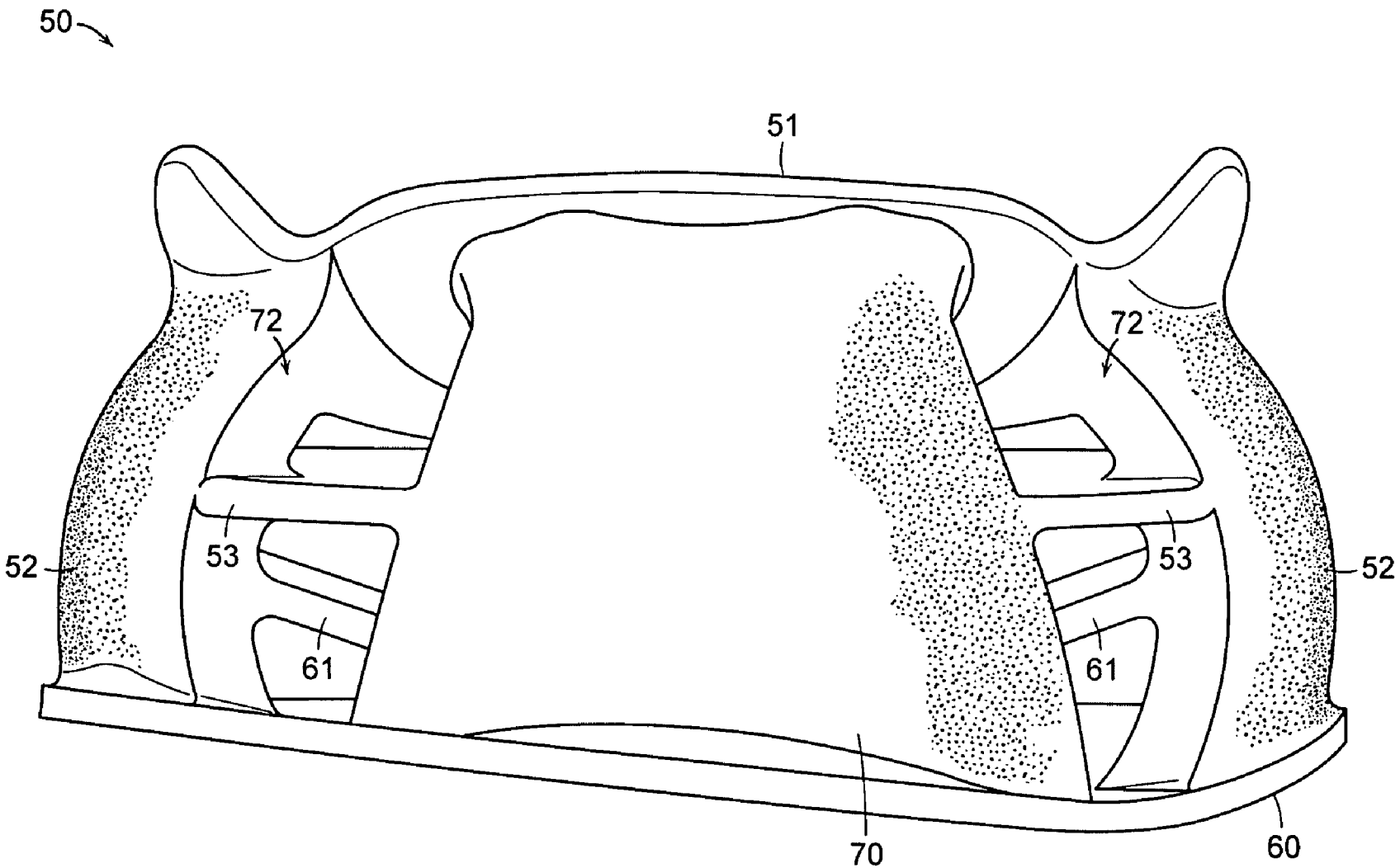
FIG. 4 is a schematic rear view of the heel part of FIG. 2.
Figure 5:
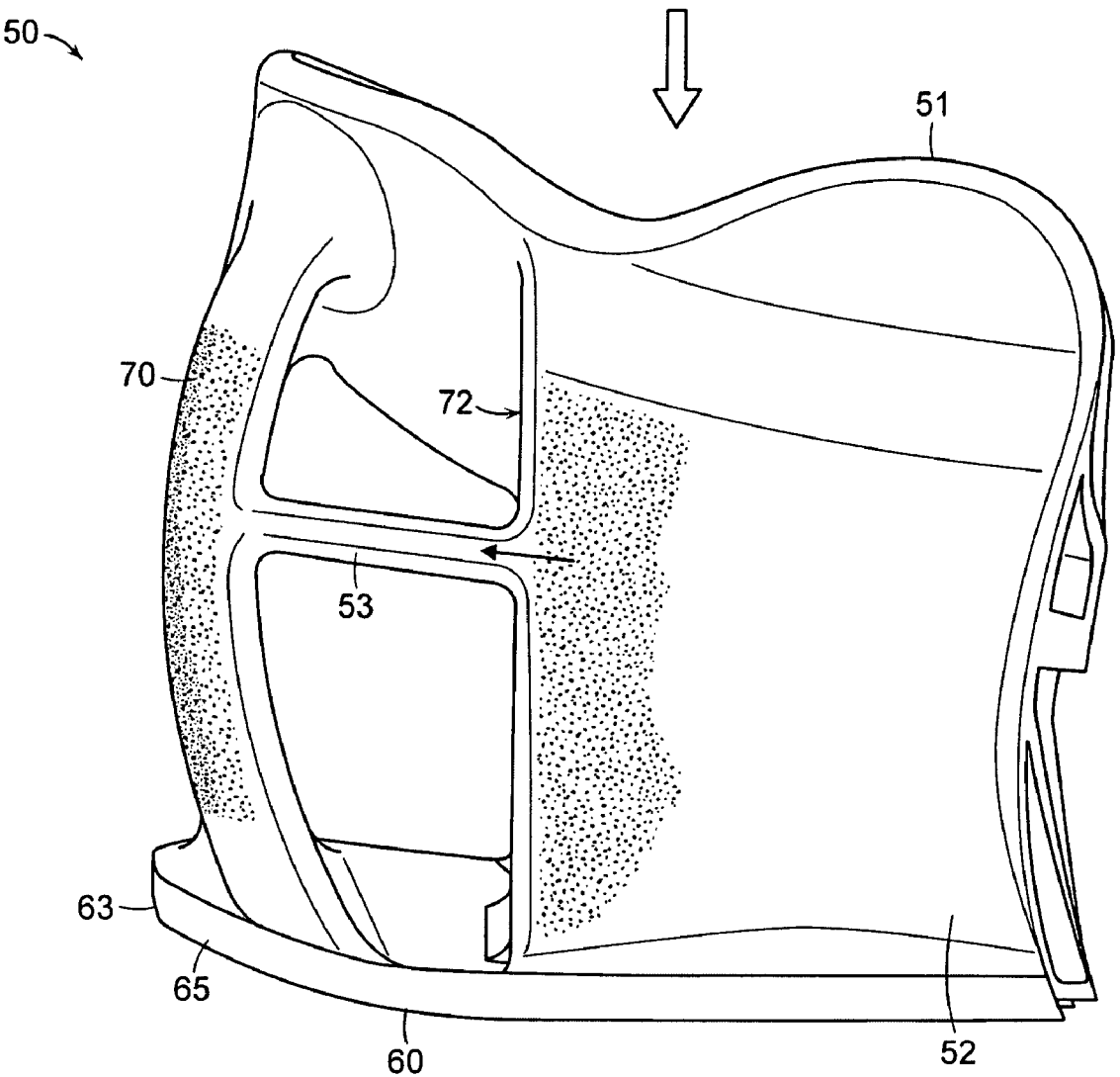
FIG. 5 is a schematic side view of the heel part of FIG. 2.
Figure 6:
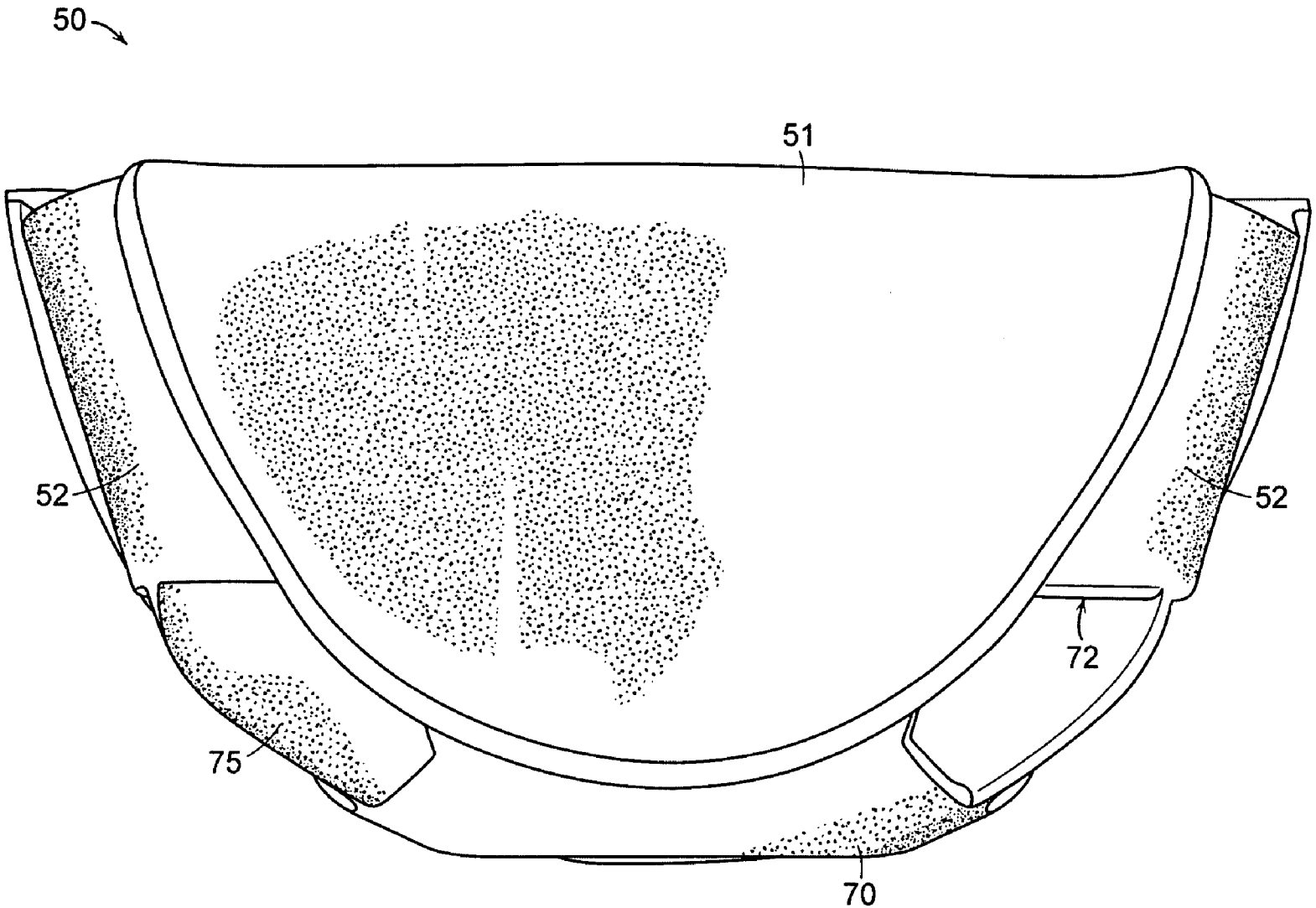
FIG. 6 is a schematic top view of the heel part of FIG. 2.

FIGS. 4-6 show the rear, side, and top of the heel part 50. As can be seen, there is a substantially vertical side wall located in a rear area of the heel part, i.e., a rear wall 70, that forms the rear portion of the heel part 50 and, thereby, of the shoe sole 10. As in the case of the other side walls 52, the rear wall 70 is outwardly curved when the heel part 50 is compressed. Accordingly, the tension element 53 is also connected to the rear wall 70 so that a further curvature of the rear wall 70 in the case of a load from above (vertical arrow in FIG. 5) leads to a rearwardly directed elongation of the tension element 53 (horizontal arrow in FIG. 5). In one embodiment, the tension element 53 engages the rear wall 70 substantially in a central region thereof. Although in the embodiment of FIGS. 2 to 6 the reinforcing elements 61 are not shown connected to the rear wall 70, it is contemplated and within the scope of the invention to extend the reinforcing elements 61 to the rear wall 70 in a similar manner as to the side walls 52 to further reinforce the heel part 50.

Additionally, as shown in FIG. 5, the rearmost section 65 of the ground surface 60 is slightly upwardly angled to facilitate the ground contact and a smooth rolling-off. Also, the aforementioned apertures 72 are clearly shown in FIGS. 4-6, along with a skin 75 covering one of the apertures 73 (see FIG. 6).

Figure 7A:
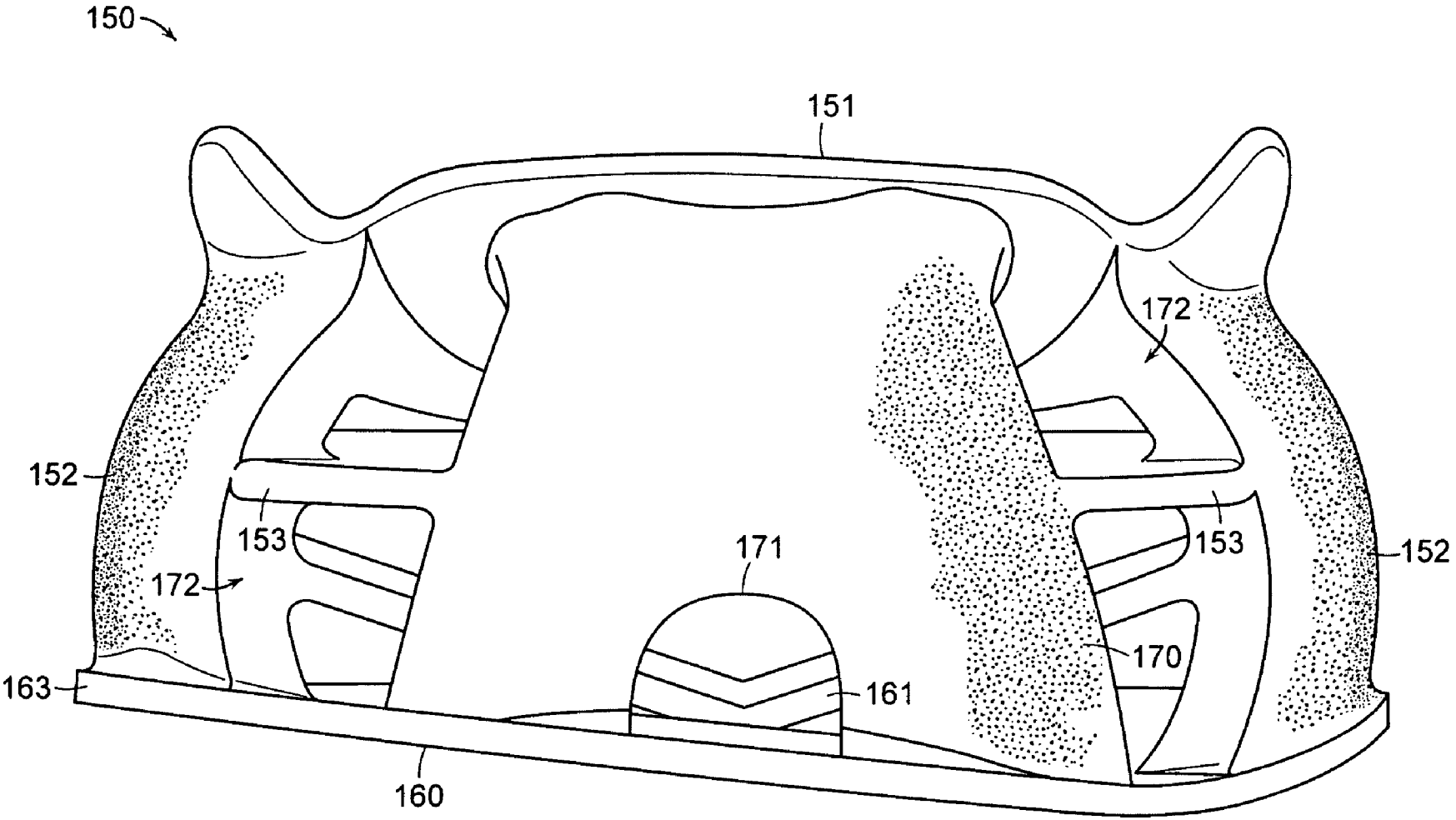
FIG. 7A is a schematic rear view of an alternative embodiment of a heel part in accordance with the invention.

FIGS. 7 and 8 present modifications of the embodiment discussed in detail above. In the following, certain differences of these embodiments compared to the heel part of FIGS. 2 to 6 are explained. FIG. 7A shows a heel part 150 with an aperture 171 arranged in the rear wall 170. The shape and the size of the aperture 171 can influence the stiffness of the heel part 150 during ground contact and may vary to suit a particular application. This is illustrated in FIGS. 9 and 10.

Figure 9:
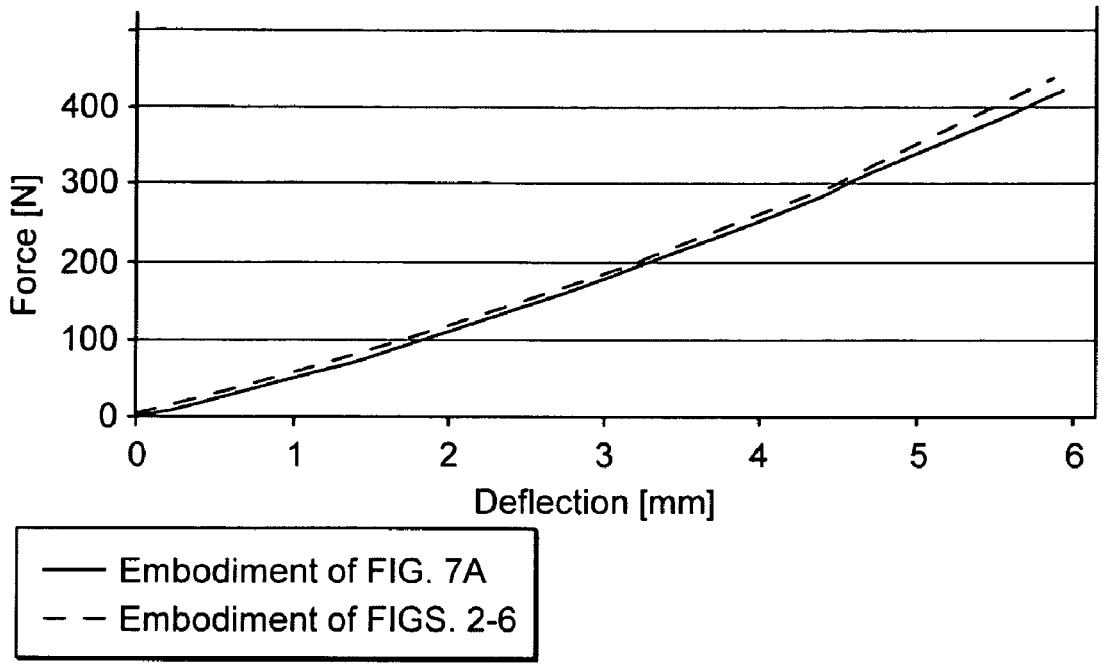
FIG. 9 is a graph comparing the vertical deformation properties of the embodiments of the heel parts shown in FIG. 2 and FIG. 7A.

FIG. 9 shows the force (Y-axis) that is necessary to vertically compress the heel part 50, 150 by a certain distance using an Instron® measuring apparatus, available from Instron Industrial Products of Grove City, Pa. The Instron® measuring apparatus is a universal test device known to the skilled person, for testing material properties under tension, compression, flexure, friction, etc. Both embodiments of the heel part 50, 150 show an almost linear graph, i.e., the cushioning properties are smooth and even at a high deflection of up to about 6 mm, the heel part 50, 150 does not collapse. A more detailed inspection shows that the heel part 150 of FIG. 7A has due to the aperture 171 a slightly lower stiffness, i.e., it leads at the same deflection to a slightly smaller restoring force.

Figure 10:
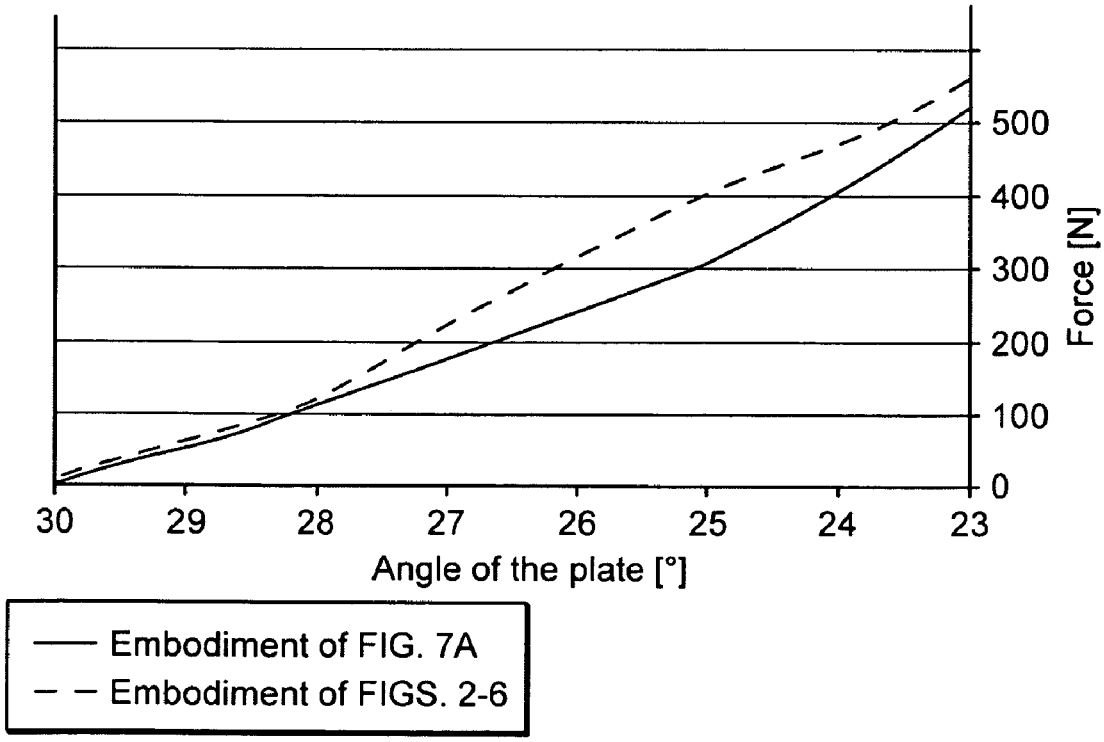
FIG. 10 is a graph comparing the deformation properties of the embodiments of the heel parts shown in FIG. 2 and FIG. 7A under a load on the contact edge of the heel part.

A similar result is obtained by an angular load test, the results of which are shown in FIG. 10. In this test, a plate contacts the rear edge of the heel part 50, 150 at first under an angle of 30° with respect to the plane of the sole. Subsequently, the restoring force of the heel part 50, 150 is measured when the angle is reduced and the heel part 50, 150 remains fixed with respect to the point of rotation of the plate. This test arrangement reflects in a more realistic manner the situation during ground contact and rolling-off, than an exclusively vertical load. Also here, the heel part 150 with the aperture 171 in the rear wall 170 provides a slightly lower restoring force than the heel part 50 of FIGS. 2-6. For both embodiments, the graph is almost linear over a wide range (from about 30° to about 23°).

Figure 7B:
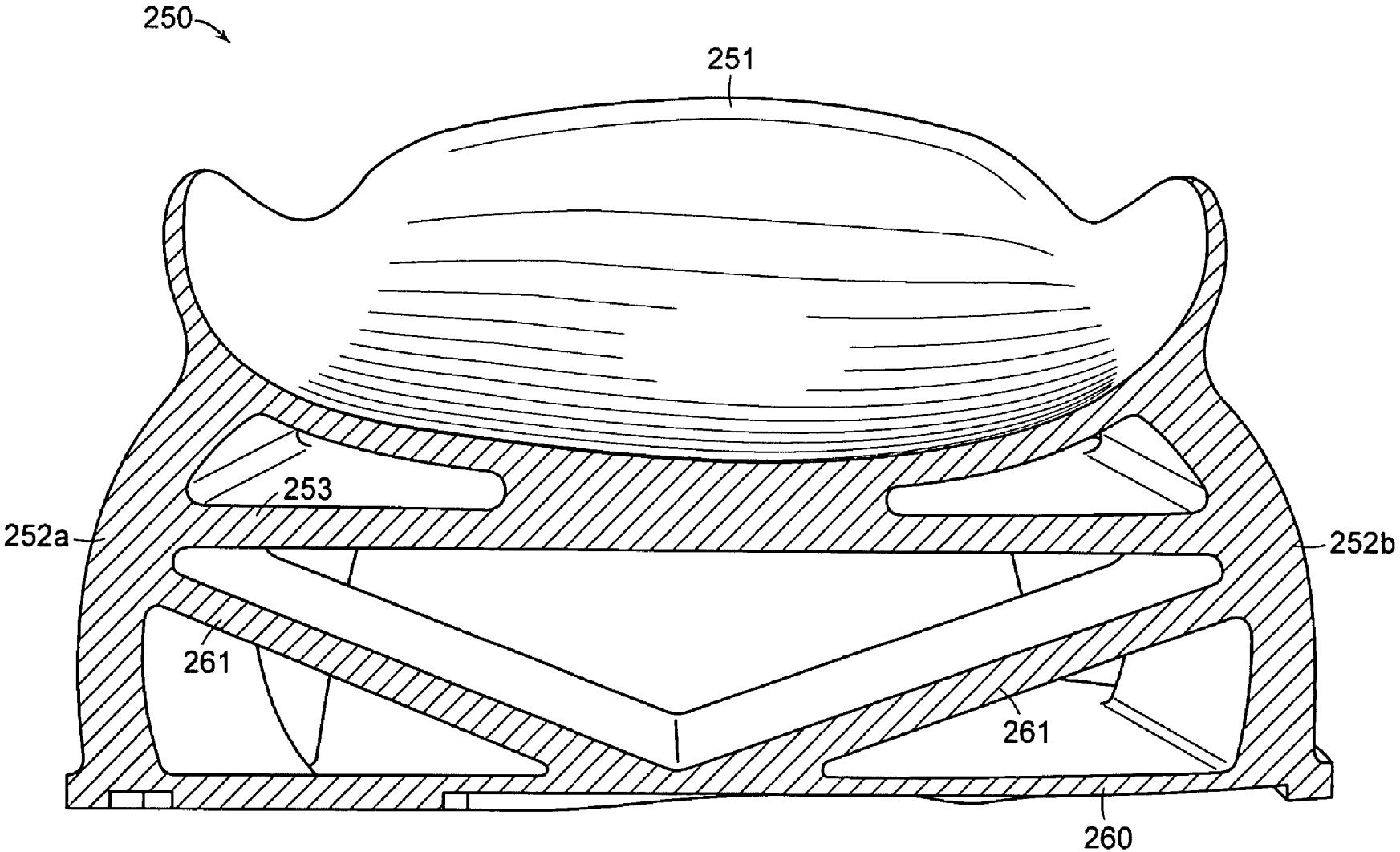
FIG. 7B is a schematic front view of an alternative embodiment of a heel part in accordance with the invention.

Whereas the embodiments of the FIGS. 2-6 are substantially symmetrical with respect to a longitudinal axis of the shoe sole, FIG. 7B displays a front view of an alternative embodiment of a heel part 250, wherein one side wall 252*b* is higher than the other side wall 252*a*. Depending on whether the higher side wall 252*b* is arranged on the medial side or the lateral side of the heel part 250, the wearer's foot can be brought into a certain orientation during ground contact to, for example, counteract pronation or supination. Additionally or alternatively, the thickness of an individual wall 252, or any other element, can be varied between the various elements and/or within a particular element to modify a structural response of the element and heel part 250.

Figure 8A:
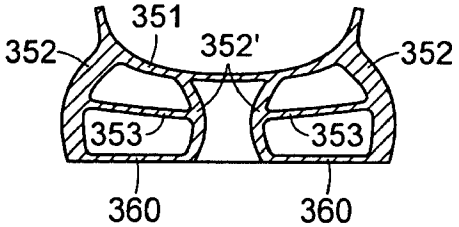
FIGS. 8A-8H are pictorial representations of alternative embodiments of a heel part in accordance with the invention.

FIGS. 8A-8H disclose pictorially the front views of a plurality of alternative embodiments of the present invention, wherein the above discussed elements are modified. In FIG. 8A, two separate structures are arranged below the heel cup 351 for the medial and the lateral sides. As a result, two additional central side walls 352' are obtained in addition to the outer lateral side wall 352 and the outer medial side wall 352, as well as independent medial and lateral tension elements 353. The ground surface 360 is also divided into two parts in this embodiment.

Figure 8B:
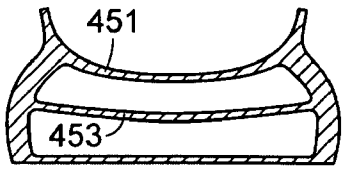
Figure 8C:
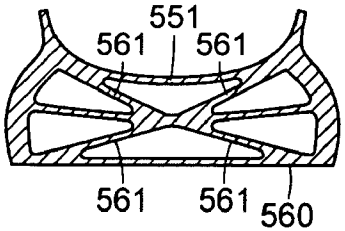

FIG. 8B shows a simplified embodiment without any reinforcing elements and without an interconnection between the heel cup 451 and the tension element 453. Such an arrangement has a lower weight and is softer than the above described embodiments; however, it has a lower stability against shear loads. The embodiment of FIG. 8C, by contrast, is particularly stable, since four reinforcing elements 561 are provided, which diagonally bridge the cavity between the heel cup 551 and the ground surface 560.

Figure 8D:
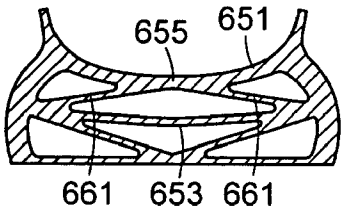
Figure 8E:
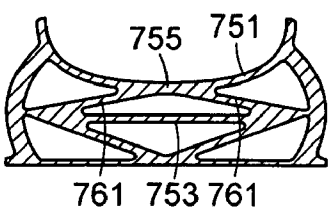
Figure 8F:
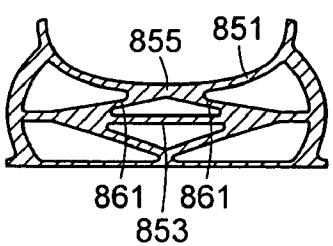

The embodiments of FIGS. 8D-8F are similar to the above described embodiments of FIGS. 2-6; however, additional reinforcing elements 661, 761, 861 are arranged extending between the tension elements 653, 753, 853 and the central regions 655, 755, 855 of the heel cups 651, 751, 851, which itself is not directly connected to the tension elements 653, 753, 853. The three embodiments differ by the connections of the reinforcing elements 661, 761, 861 to the tension elements 653, 753, 853. Whereas in the embodiment of FIG. 8D, the connection points are at the lateral and medial edges of the tension element 653, they are, in the embodiments of FIG. 8E and in particular FIG. 8F, moved further to the center of the tension elements 753, 853.

Figure 8G:
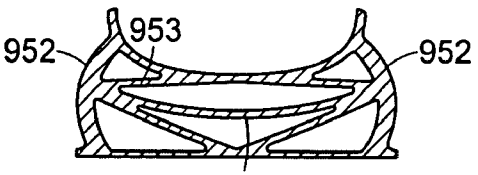
Figure 8H:
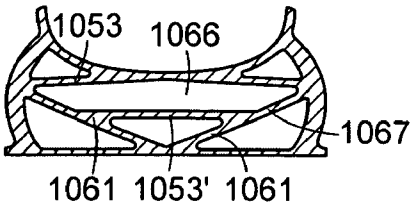

The embodiments of FIGS. 8G and 8H include a second tension element 953', 1053' below the first tension element 953. 1053. Whereas the first tension element 953, 1053 is in these embodiments slightly upwardly curved, the second tension element 953' has a downwardly directed curvature. In the embodiment of FIG. 8G, the second tension element 953' bridges the overall distance between the medial and lateral side walls 952 in a similar manner to the first tension element 953. In the embodiment of FIG. 8H, the second tension element 1053' extends substantially between mid-points of the reinforcing elements 1061. In addition, the embodiment of FIG. 8H includes an additional cushioning element 1066 disposed within a cavity 1067 formed by the tension and reinforcing elements 1053, 1061, as described in greater detail hereinbelow.

Figure 11A:
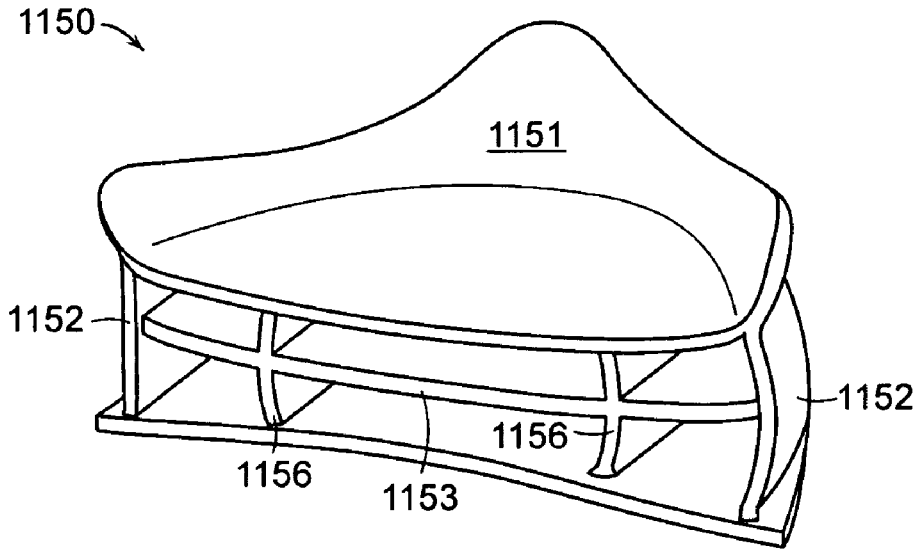
FIG. 11A is a schematic front view of an alternative embodiment of a heel part in accordance with the invention for use in a basketball shoe.
Figure 11B:
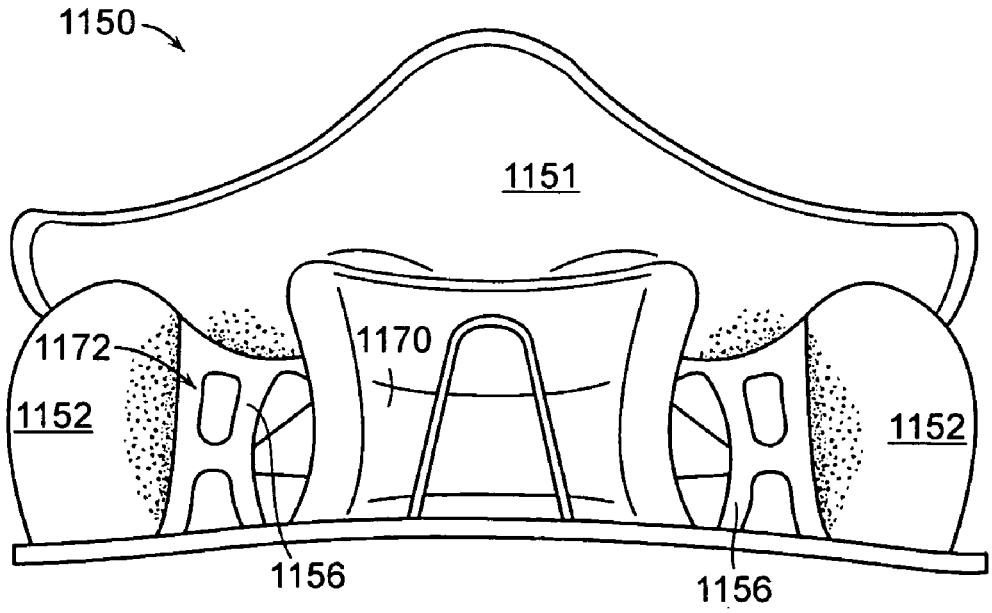
FIG. 11B is a schematic rear view of the heel part of FIG. 11A.

FIGS. 11A and 11B depict another alternative embodiment of a heel part 1150 in accordance with the invention, suitable for use in a basketball shoe. As shown in FIG. 11A, two additional inner side walls 1156 are provided to reinforce the construction against the significant compression and shearing loads occurring in basketball. As shown in FIG. 11B, this embodiment includes a continuous rear wall 1170, which, as explained above, also achieves a higher compression stability. On the whole, a particularly stable construction is obtained with a comparatively flat arrangement, which, if required, may be further reinforced by the arrangement of additional inner side walls 1156.

Figure 12:
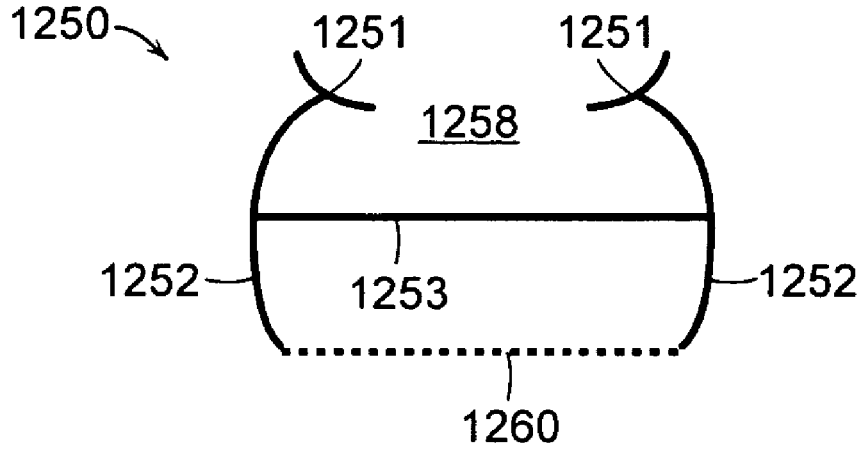
FIG. 12 is a pictorial representation of an alternative embodiment of a heel part in accordance with the invention, where a heel rim is used instead of the heel cup.

Another alternative embodiment of a heel part 1250 is pictorially represented in FIG. 12, in which a heel rim 1251 is included instead of the continuous heel cup 51 depicted in FIGS. 2-6. Like the aforementioned heel cup 51, the heel rim 1251 has an anatomical shape, i.e., it has a curvature that substantially corresponds to the shape of the human heel in order to securely guide the foot during the cushioning movement of the heel part. The heel rim 1251, therefore, encompasses the foot at the medial side, the lateral side, and from the rear. The heel part 1250 depicted includes lateral and medial side walls 1252, a tension element 1253, and an optional ground surface 1260; however, the heel part 1250 could include any of the arrangements of side walls, tension elements, reinforcing elements, and ground surfaces as described herein. In the embodiment shown, the heel part 1251 differs from the aforementioned heel cup 51 by a central aperture or cut-out 1258, which, depending on the embodiment, may be of different sizes and shapes to suit a particular application. This deviation facilitates the arrangement of an additional cushioning element directly below a calcaneus bone of the heel, for example, a foamed material to achieve a particular cushioning characteristic.

Figure 13:
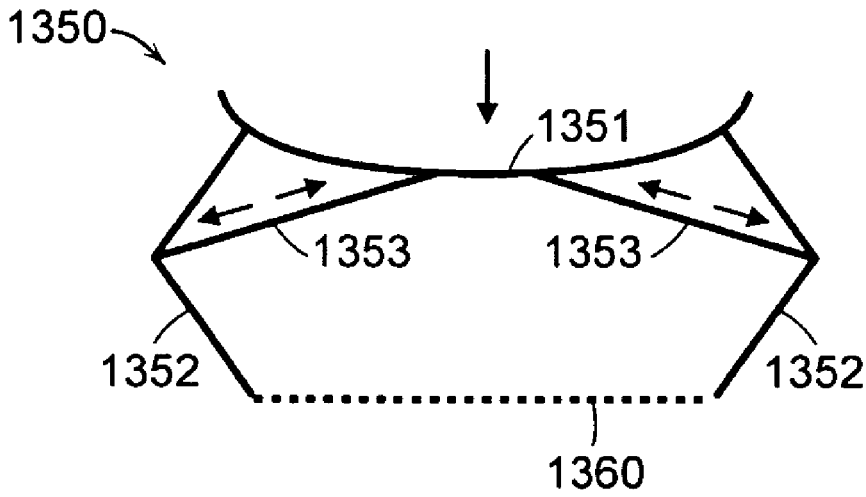
FIG. 13 is a pictorial representation of an alternative embodiment of a heel part in accordance with the invention, with angled side walls and tension elements extending between the side walls and a heel cup.

Yet another alternative embodiment of a heel part 1350 is pictorially represented in FIG. 13. The heel part 1350 includes angled side walls 1352 instead of the slightly bent or curved side walls 52 of the aforementioned embodiments. Additionally, the tension element 1353 in this embodiment does not directly interconnect the two sidewalls 1352, instead two tension elements 1353 each interconnect one side wall 1352 to the heel cup 1351; however, additional tension elements and reinforcing elements could also be included. An optional ground surface 1360 may also be provided in this embodiment.

Furthermore, the plurality of cavities resulting from the various arrangements of the aforementioned elements may also be used for cushioning. For example, the cavities may either be sealed in an airtight manner or additional cushioning elements made from, for example, foamed materials, a gel, or the like arranged inside the cavities (see FIG. 8H).

The size and shape of the heel part and its various elements may vary to suit a particular application. The heel part and elements can have essentially any shape, such as polygonal, arcuate, or combinations thereof. In the present application, the term polygonal is used to denote any shape including at least two line segments, such as rectangles, trapezoids, and triangles, and portions thereof. Examples of arcuate shapes include circles, ellipses, and portions thereof.

Generally, the heel part can be manufactured by, for example, molding or extrusion. Extrusion processes may be used to provide a uniform shape. Insert molding can then be used to provide the desired geometry of open spaces, or the open spaces could be created in the desired locations by a subsequent machining operation. Other manufacturing techniques include melting or bonding. For example, the various elements may be bonded to the heel part with a liquid epoxy or a hot melt adhesive, such as EVA. In addition to adhesive bonding, portions can be solvent bonded, which entails using a solvent to facilitate fusing of the portions to be added. The various components can be separately formed and subsequently attached or the components can be integrally formed by a single step called dual injection, where two or more materials of differing densities are injected simultaneously.

In addition to the geometric arrangement of the framework-like structure below the heel plate, the material selection can also determine the dynamic properties of the heel part. In one embodiment, the integrally interconnected components of the heel are manufactured by injection molding a suitable thermoplastic urethane (TPU). If necessary, certain components, such as the tension element, which are subjected to high tensile loads, can be made from a different plastic material than the rest of the heel part. Using different materials in the single piece heel part can easily be achieved by a suitable injection molding tool with several sprues, or by co-injecting through a single sprue, or by sequentially injecting the two or more plastic materials.

Additionally, the various components can be manufactured from other suitable polymeric material or combination of polymeric materials, either with or without reinforcement. Suitable materials include: polyurethanes; EVA; thermoplastic polyether block amides, such as the Pebax® brand sold by Elf Atochem; thermoplastic polyester elastomers, such as the Hytrel® brand sold by DuPont; thermoplastic elastomers, such as the Santoprene® brand sold by Advanced Elastomer Systems, L.P.; thermoplastic olefin; nylons, such as nylon 12, which may include 10 to 30 percent or more glass fiber reinforcement; silicones; polyethylenes; acetal; and equivalent materials. Reinforcement, if used, may be by inclusion of glass or carbon graphite fibers or para-aramid fibers, such as the Kevlar® brand sold by DuPont, or other similar method. Also, the polymeric materials may be used in combination with other materials, for example natural or synthetic rubber. Other suitable materials will be apparent to those skilled in the art.

Figure 14:
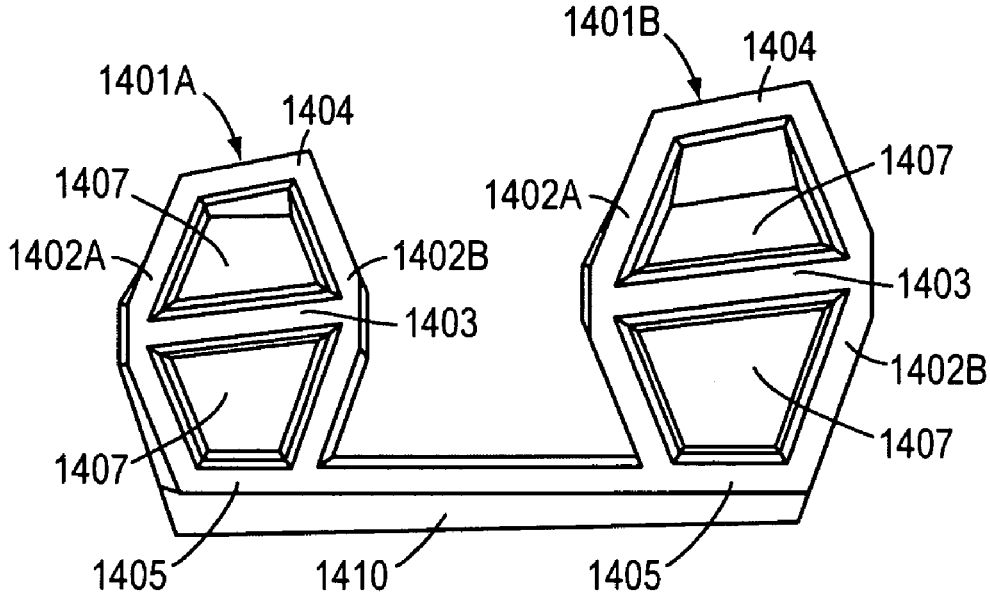
FIG. 14 is a schematic side view of two second deformation elements in accordance with one embodiment of the invention interconnected for use.

FIG. 14 depicts one embodiment of second deformation elements 1401A, 1401B for a shoe sole 1450 (see FIG. 21) in accordance with the invention. As shown, the second deformation elements 1401A, 1401B are open-walled structures that define hollow volumes 1407 within the shoe sole 1450 and are free from any foamed material. In comparison to standard foamed materials of similar size, the second deformation elements 1401A, 1401B are reduced in weight by about 20% to about 30%. In one embodiment, each second deformation element 1401A, 1401B has a honeycomb-like shape that includes two facing and non-linear (e.g., slightly angled) side walls 1402A, 1402B. Alternatively, in other embodiments, the second deformation elements 1401A, 1401B assume a variety of other shapes.

The side walls 1402A, 1402B may be interconnected by a tension element 1403. The structure provided by the side walls 1402A, 1402B and the interconnecting tension element 1403 results in deformation properties for the shoe sole 1450 of the invention that substantially correspond to the behavior of an ordinary midsole made exclusively of foamed materials. As explained below, when small forces are applied to the second deformation elements 1401A, 1401B, small deformations of the side walls 1402A, 1402B result. When larger forces are applied, the resulting tension force on the tension element 1403 is large enough to extend the tension element 1403 and thereby provide for a larger deformation. Over a wide range of loads, this structure results in deformation properties that correspond to the those of a standard foamed midsole.

Figure 16:
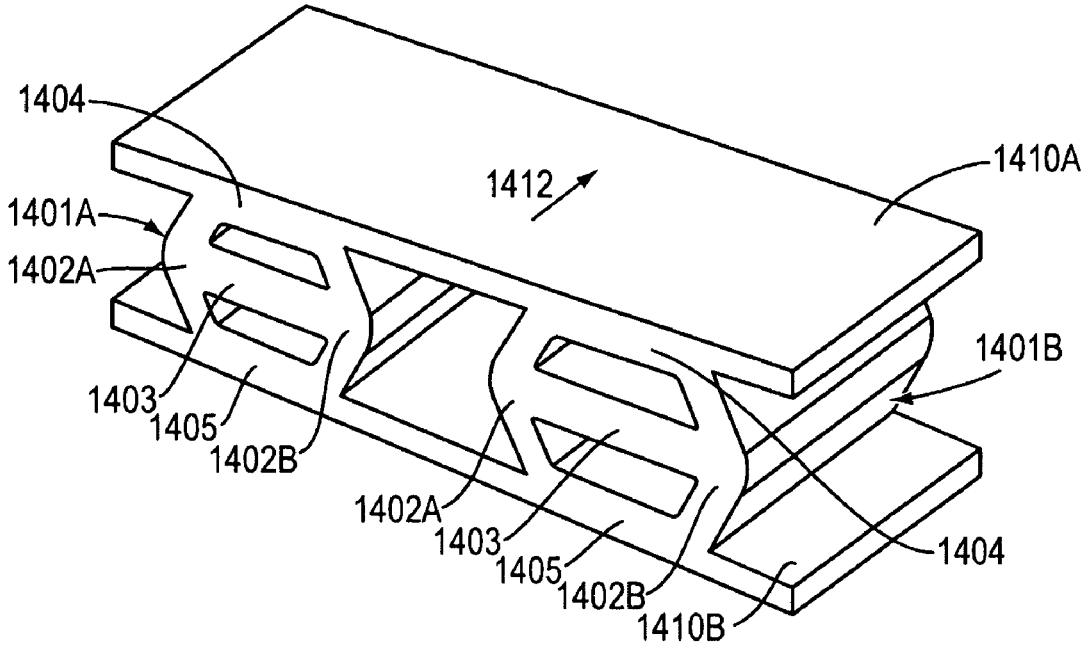
FIG. 16 is a schematic perspective view of an alternative embodiment of two second deformation elements in accordance with the invention interconnected in an unloaded state.

In one embodiment, the tension element 1403 extends from approximately a center region of one side wall 1402A to approximately a center region of the other side wall 1402B. The thickness of the side walls 1402A, 1402B and of the tension element 1403, and the location of the tension element 1403, may be varied to suit a particular application. For example, the thickness of the side walls 1402A, 1402B and of the tension element 1403 may be varied in order to design mechanical properties with local differences. In one embodiment, the thickness of the side walls 1402A, 1402B and/or of the tension element 1403 increases along a length of each of the second deformation elements 1401A, 1401B, as illustrated in FIG. 16 by the arrow 1412. In the case of injection-molding production, this draft facilitates removal of the second deformation element 1401A, 1401B from the mold. In one embodiment, the thickness of the side walls 1402A, 1402B and/or of the tension element 1403 ranges from about 1.5 mm to about 5 mm.

Referring again to FIG. 14, in one embodiment, the side walls 1402A, 1402B of each second deformation element 1401A, 1401B are further interconnected by an upper side 1404 and a lower side 1405. The upper side 1404 and the lower side 1405 serve as supporting surfaces. Additionally, in another embodiment, two or more of the second deformation elements 1401 are interconnected to each other at their lower side 1405 by a connecting surface 1410, as shown. Alternatively, the connecting surface 1410 may interconnect two or more of the second deformation elements 1401 at their upper side 1404. The connecting surface 1410 stabilizes the two or more second deformation elements 1401A, 1401B. Additionally, the connecting surface 1410 provides a greater contact surface for attachment of the second deformation elements 1401A, 1401B to other sole elements and thereby facilitates the anchoring of the second deformation elements 1401A, 1401B to the shoe sole 1450. The second deformation elements 1401A, 1401B may be attached to other sole elements by, for example, gluing, welding, or other suitable means.

In another embodiment, the connecting surface 1410 is three-dimensionally shaped in order to allow a more stable attachment to other sole elements, such as, for example, a load distribution plate 1452, which is described below with reference to FIGS. 20 and 21. The three dimensional shape of the connecting surface 1410 also helps to increase the lifetime of the shoe sole 1450. In one embodiment, referring now to FIG. 15, a recess 1411 in the connecting surface 1410 gives the connecting surface 1410 its three dimensional shape.

Figure 15:
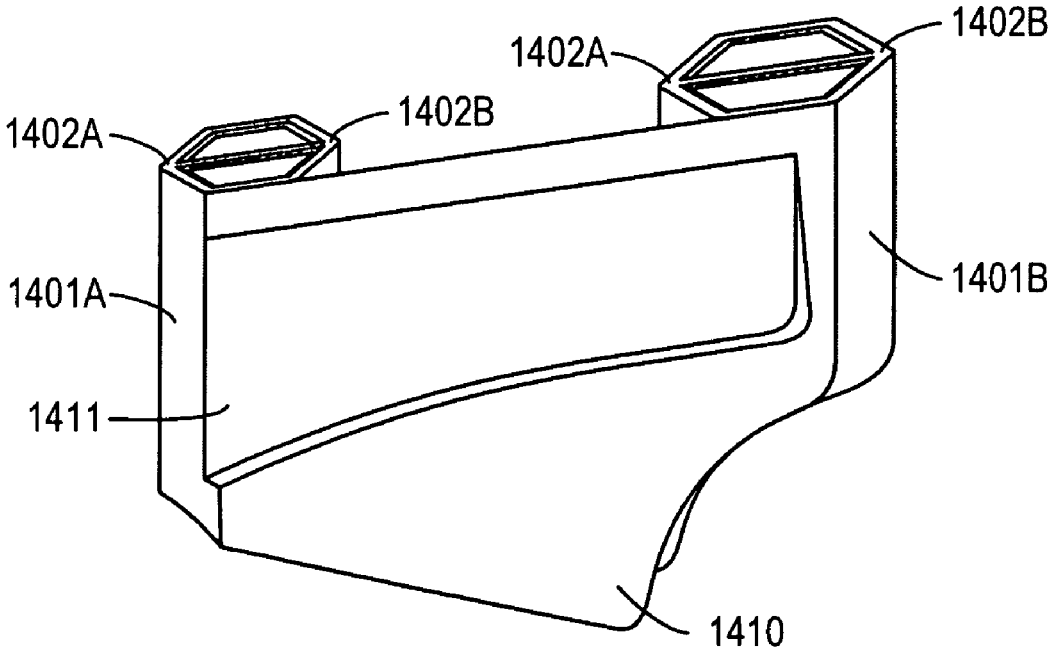
FIG. 15 is a schematic perspective bottom view of the two second deformation elements of FIG. 14.

In one embodiment, as shown in FIGS. 14 and 15, one second deformation element 1401B is larger in size than the other second deformation element 1401A. This reflects the fact that the second deformation elements 1401A, 1401B are, in one embodiment, arranged in regions of the shoe sole 1450 having different thicknesses.

Figure 17:
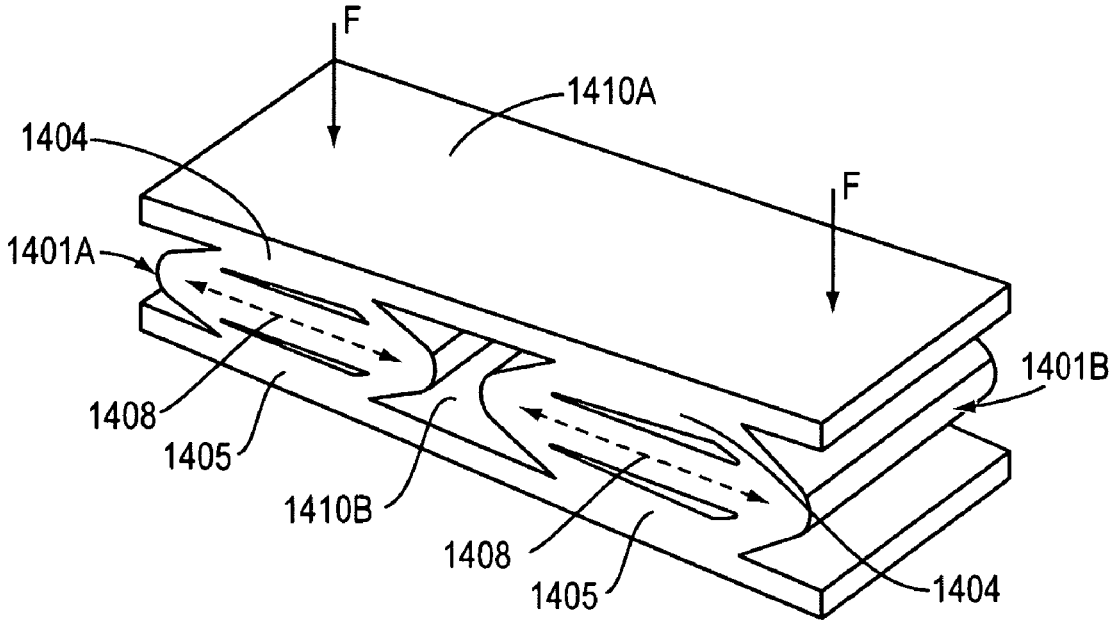
FIG. 17 is a schematic perspective view of the two second deformation elements of FIG. 16 in a compressed state.

FIGS. 16 and 17 depict an alternative embodiment of interconnected second deformation elements 1401A, 1401B. As shown, the second deformation elements 1401A, 1401B are interconnected at both their upper side 1404 and their lower side 1405 by connecting surfaces 1410A, 1410B, respectively. Whereas FIG. 16 depicts the unloaded state of the second deformation elements 1401A, 1401B, FIG. 17 schematically depicts the loaded state of the second deformation elements 1401A, 1401B. In the case of a small load, there is only a small deflection of the side walls 1402A, 1402B without a substantial change in shape of the tension element 1403. Greater loads, however, results in an elongation of the tension element 1403. Larger pressure forces F acting from above, and/or from below, are, therefore, transformed by the second deformation elements 1401A, 1401B into a tension inside the tension element 1403, as indicated by dashed double headed arrows 1408 in FIG. 17. Due to the tension element 1403, the second deformation elements 1401A, 1401B, even in the case of a peak load, are not simply flattened, but, rather, elastically deformed. This approximates the results that would otherwise be achieved by using deformation elements made from foamed materials.

Figure 18:
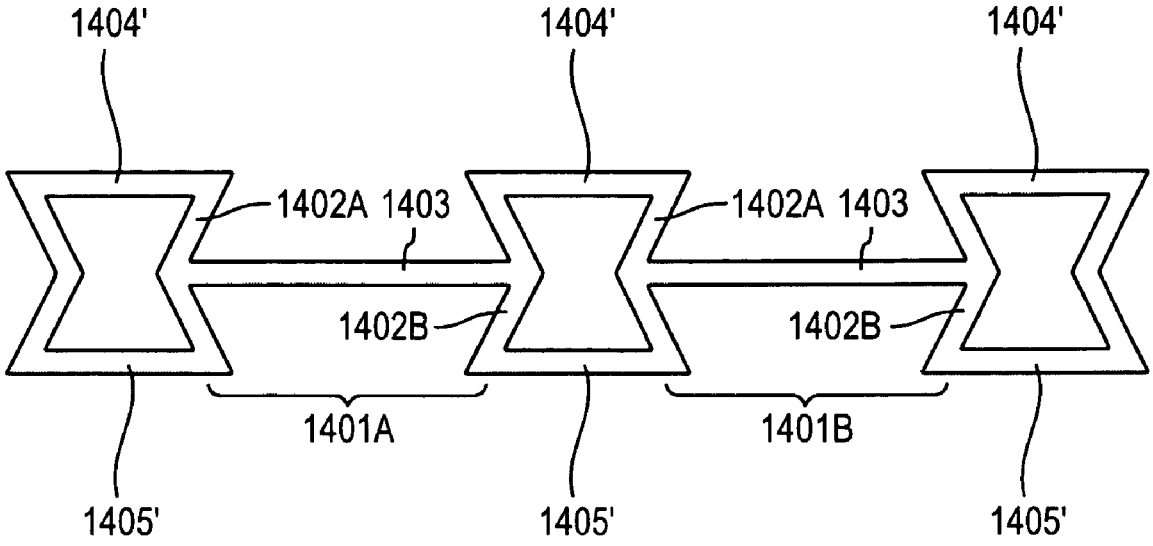
FIG. 18 is a schematic side view an alternative embodiment of a series of second deformation elements in accordance with the invention.

FIG. 18 depicts yet another embodiment of interconnected second deformation elements 1401A, 1401B for use in a shoe sole 1450 in accordance with the invention. Unlike the illustrative embodiments of FIGS. 14-17, the side walls 1402A, 1402B of the same second deformation element 1401A or 1401B are not interconnected by an upper side 1404 or a lower side 1405. Rather, the structure has been modified such that an upper side 1404' and a lower side 1405' each interconnect side walls 1402A, 1402B of adjacent second deformation elements 1401A, 1401B. In this alternative embodiment, a connecting surface 1410 may also be used to interconnect a number of the second deformation elements 1401 on their upper side 1404 and/or lower side 1405. The illustrative embodiment of the second deformation elements 1401A, 1401B shown in FIG. 18 is particularly appropriate for use in sole areas having a low height, such as, for example, at the front end of shoe sole 1450.

Figure 19A:
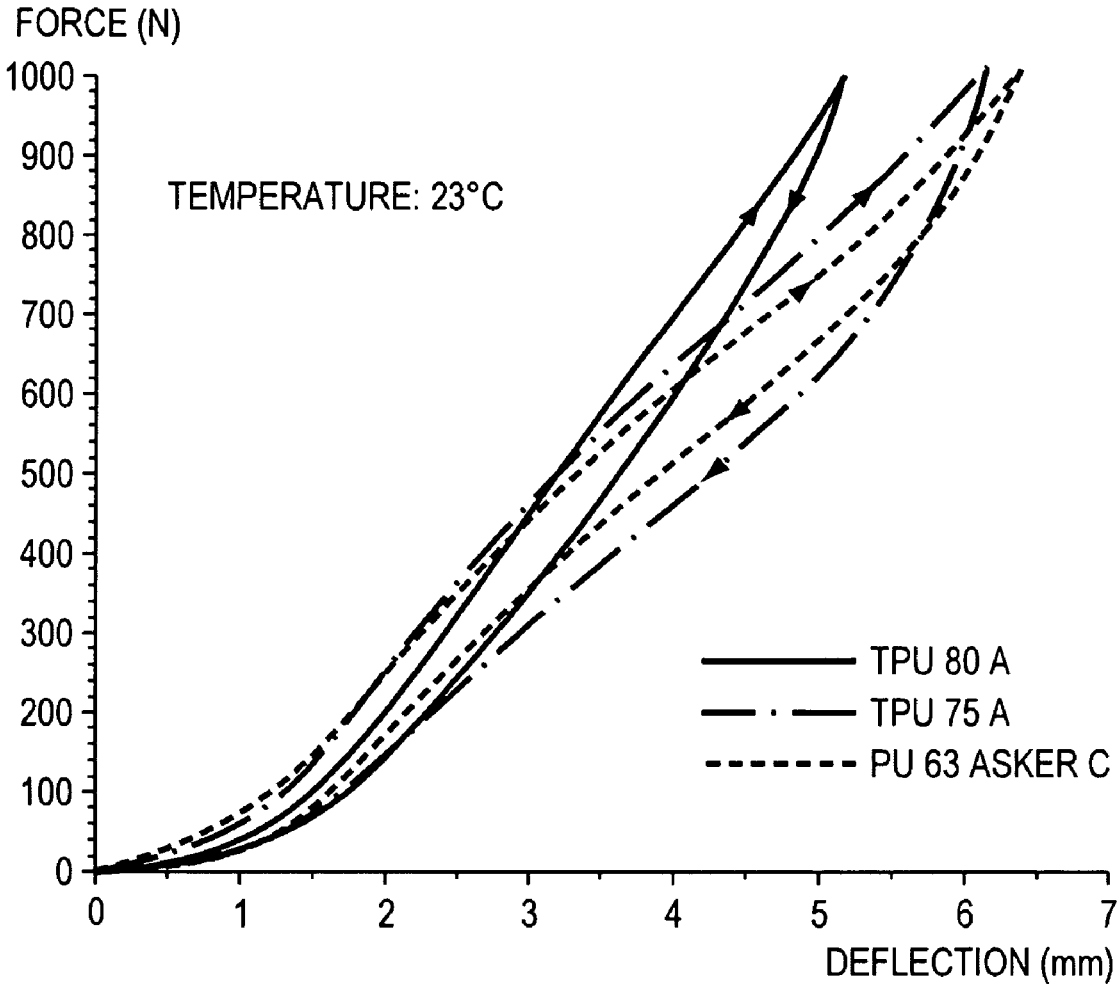
FIG. 19A is a graph depicting comparative measurements of the deformation properties at 23° C. of second deformation elements in accordance with the invention and of a prior art deformation element made out of a foamed material.
Figure 19B:
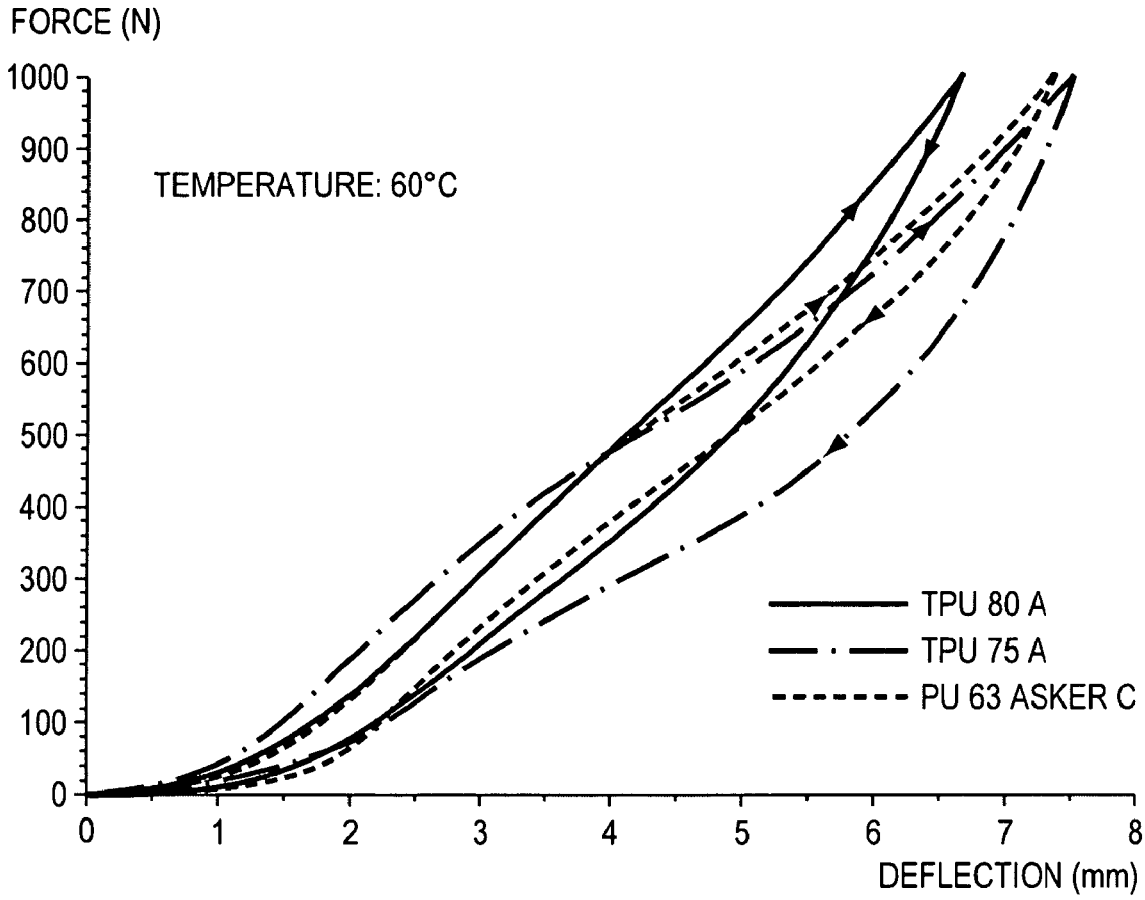
FIG. 19B is a graph depicting comparative measurements of the deformation properties at 60° C. of second deformation elements in accordance with the invention and of a prior art deformation element made out of a foamed material.

FIGS. 19A and 19B depict the strong similarity in deformation characteristics, at a surrounding temperature of 23° C. and 60° C., respectively, between the second deformation elements 1401 of the present invention and a prior art deformation element made from foamed materials. Referring to FIGS. 19A and 19B, hysteresis curves for the deflection of two different second deformation elements 1401 according to the invention are shown. In a first case, the second deformation elements 1401 are made from thermoplastic polyurethane (TPU) with a Shore A hardness of 80. In a second case, the second deformation elements 1401 are made from TPU with a Shore A hardness of 75. For comparison purposes, a hysteresis curve for a prior art foamed deformation element made from polyurethane with an Asker C hardness of 63 is also depicted. These are typical values for deformation elements used in the midsoles of sports shoes.

In the graphs of FIGS. 19A and 19B, the force applied to the deformation elements by means of an oscillating stamp is measured along the Y-axis and the deflection of the deformation elements is measured along the X-axis. The gradient of an obtained curve indicates the stiffness of the deformation element in question, whereas the area between the increasing branch (loading) and the decreasing branch (unloading) of the curve reflects the energy loss during deformation, i.e., energy which is not elastically regained but irreversibly transformed into heat by means of, for example, relaxation processes. At 23° C. (i.e., room temperature) and at 60° C., consistency exists, to a great extent, in the behavior of the second deformation elements according to the invention and the prior art foamed element. Moreover, long term studies do not show a substantial difference in their deformation properties.

Figure 19C:
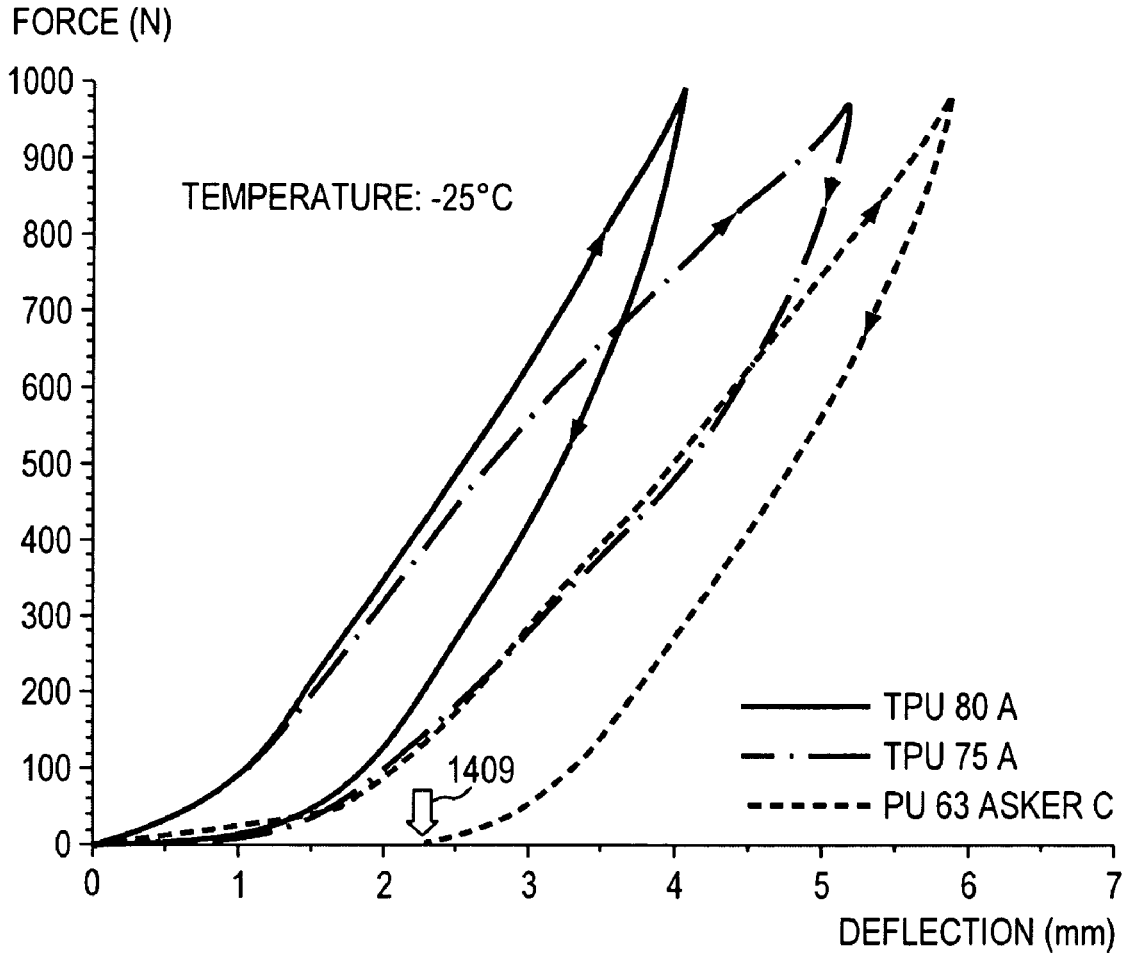
FIG. 19C is a graph depicting comparative measurements of the deformation properties at −25° C. of second deformation elements in accordance with the invention and of a prior art deformation element made out of a foamed material.

Referring now to FIG. 19C, it can be seen, however, that the behavior of the second deformation elements in accordance with the invention and the prior art foamed element is different at the low temperature of −25° C. Whereas the second deformation elements according to the invention still show a substantially elastic behavior and, in particular, return to their starting configuration after the external force is removed, the foamed deformation element of the prior art remains permanently deformed at a deflection of approximately 2.3 mm, as indicated by arrow 1409 in FIG. 19C. As such, while the deformation properties of the second deformation elements in accordance with the present invention are almost independent from the ambient temperature, the deformation properties of the foamed deformation element of the prior art is not. As a result, the foamed deformation element of the prior art is not suitable for use in a shoe sole.

In contrast to the known deformation elements of the prior art, the second deformation elements in accordance with the invention can be modified in many aspects to obtain specific properties. For example, changing the geometry of the second deformation elements 1401 (e.g., larger or smaller distances between the side walls 1402A, 1402B, the upper side 1404 and the lower side 1405, and/or the upper side 1404' and the lower side 1405'; changes to the thickness of the side walls 1402A, 1402B and/or the tension element 1403; additional upper sides 1404, 1404' and/or lower sides 1405, 1405'; changes to the angle of the side walls 1402A, 1402B; and convex or concave borders for reinforcing or reducing stiffness) or using different materials for the second deformation elements enables adaptation of the second deformation elements to their respective use. For example, the second deformation elements in accordance with the invention can be modified to take into account the particular positions of the second deformation elements within the shoe sole 1450, their tasks, and/or the requirements for the shoe in general, such as, for example, its expected field of use and the size and weight of the wearer.

The various components of the second deformation elements can be manufactured by, for example, injection molding or extrusion. Extrusion processes may be used to provide a uniform shape, such as a single monolithic frame. Insert molding can then be used to provide the desired geometry of, for example, the recess 1411 and the hollow volumes 1407, or the hollow volumes 1407 could be created in the desired locations by a subsequent machining operation. Other manufacturing techniques include melting or bonding additional portions. For example, the connecting surfaces 1410 may be adhered to the upper side 1404 and/or the lower side 1405 of the second deformation elements 1401A, 1401B with a liquid epoxy or a hot melt adhesive, such as ethylene vinyl acetate (EVA). In addition to adhesive bonding, portions can be solvent bonded, which entails using a solvent to facilitate fusing of the portions to be added to the sole 1450. The various components can be separately formed and subsequently attached or the components can be integrally formed by a single step called dual injection, where two or more materials of differing densities are injected simultaneously.

The various components can be manufactured from any suitable polymeric material or combination of polymeric materials, either with or without reinforcement. Suitable materials include: polyurethanes, such as a thermoplastic polyurethane (TPU); EVA; thermoplastic polyether block amides, such as the Pebax® brand sold by Elf Atochem; thermoplastic polyester elastomers, such as the Hytrel® brand sold by DuPont; thermoplastic elastomers, such as the Santoprene® brand sold by Advanced Elastomer Systems, L.P.; thermoplastic olefin; nylons, such as nylon 12, which may include 10 to 30 percent or more glass fiber reinforcement; silicones; polyethylenes; acetal; and equivalent materials. Reinforcement, if used, may be by inclusion of glass or carbon graphite fibers or para-aramid fibers, such as the Kevlar® brand sold by DuPont, or other similar method. Also, the polymeric materials may be used in combination with other materials, for example natural or synthetic rubber. Other suitable materials will be apparent to those skilled in the art.

Figure 20:
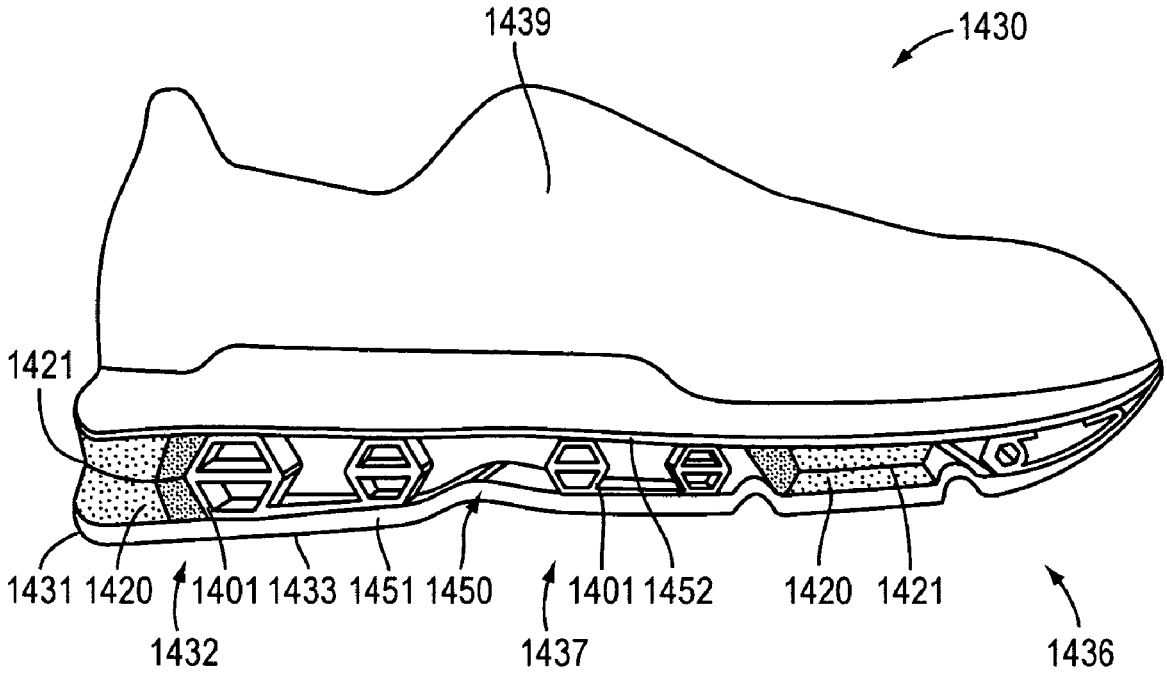
FIG. 20 is a schematic side view of an article of footwear including a shoe sole in accordance with one embodiment of the invention.

FIG. 20 depicts one embodiment of an article of footwear 1430 that includes an upper 1439 and a sole 1450 in accordance with the invention. FIG. 21 depicts an exploded view of one embodiment of the shoe sole 1450 for the article of footwear 1430 of FIG. 20. Using the second deformation elements 1401 in certain sole regions and not others can create pressure points on the foot and be uncomfortable for athletes. Accordingly, as shown in FIGS. 20 and 21, a plurality of first deformation elements 1420 made out of foamed materials may be arranged in particularly sensitive sole areas and a plurality of second deformation elements 1401 may be arranged in other areas. The second deformation elements 1401 and the first deformation elements 1420 are, in one embodiment, arranged between an outsole 1451 and the load distribution plate 1452.

In one embodiment, one or more first deformation elements 1420 made out of a foamed material are arranged in an aft portion 1431 of a heel region 1432 of the sole 1450. Placement of the first deformation elements 1420 in the aft portion 1431 of the heel region 1432 of the sole 1450 optimally cushions the peak loads that arise on the foot during the first ground contact, which is a precondition for a particularly high comfort for a wearer of the article of footwear 1430. As shown, in one embodiment, the first deformation elements 1420 further include horizontally extending indentations/grooves 1421 to facilitate deformation in a predetermined manner.

Figure 21:
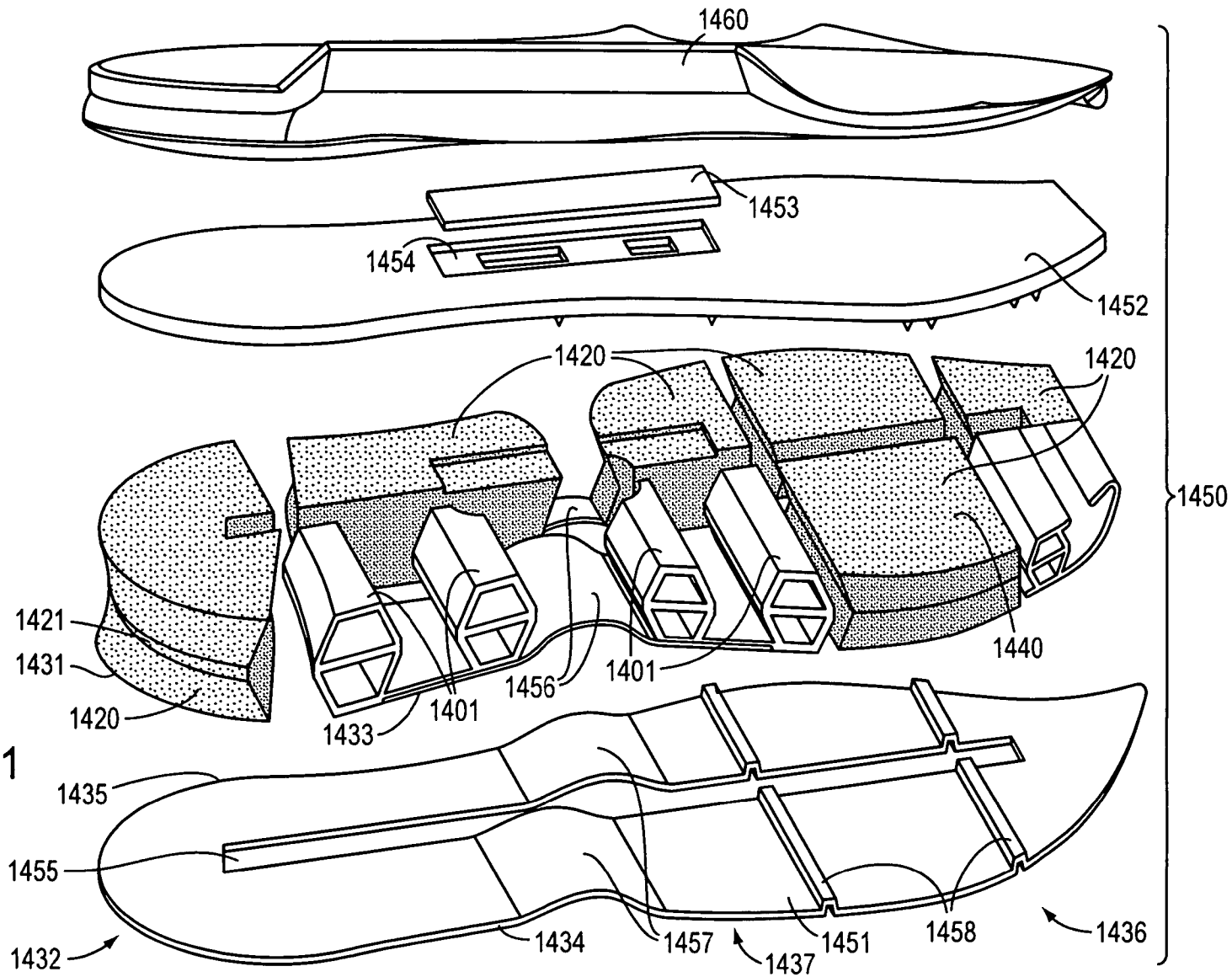
FIG. 21 is an exploded schematic perspective view of the construction of the shoe sole of FIG. 20.

Referring still to FIGS. 20 and 21, second deformation elements 1401 are, in one embodiment, provided in a front portion 1433 of the heel region 1432 to assist the one or more first deformation elements 1420 in the aft portion 1431 and to assure, in case of their failure (e.g., due to low temperatures), a minimum amount of elasticity for the shoe sole 1450. Moreover, placement of the second deformation elements 1401 in the front portion 1433 of the heel region 1432 of the sole 1450 simultaneously avoids premature wear of the first deformation elements 1420 in the heel region 1432.

The distribution of the second deformation elements 1401 and the first deformation elements 1420 on the medial side 1434 and the lateral side 1435 of the sole 1450, as well as their individual specific deformation properties, can be tuned to the desired requirements, such as, for example, avoiding supination or excessive pronation. In one particular embodiment, this is achieved by making the above mentioned geometrical changes to the second deformation elements 1401 and/or by selecting appropriate material(s) for the second deformation elements 1401.

Figure 22:
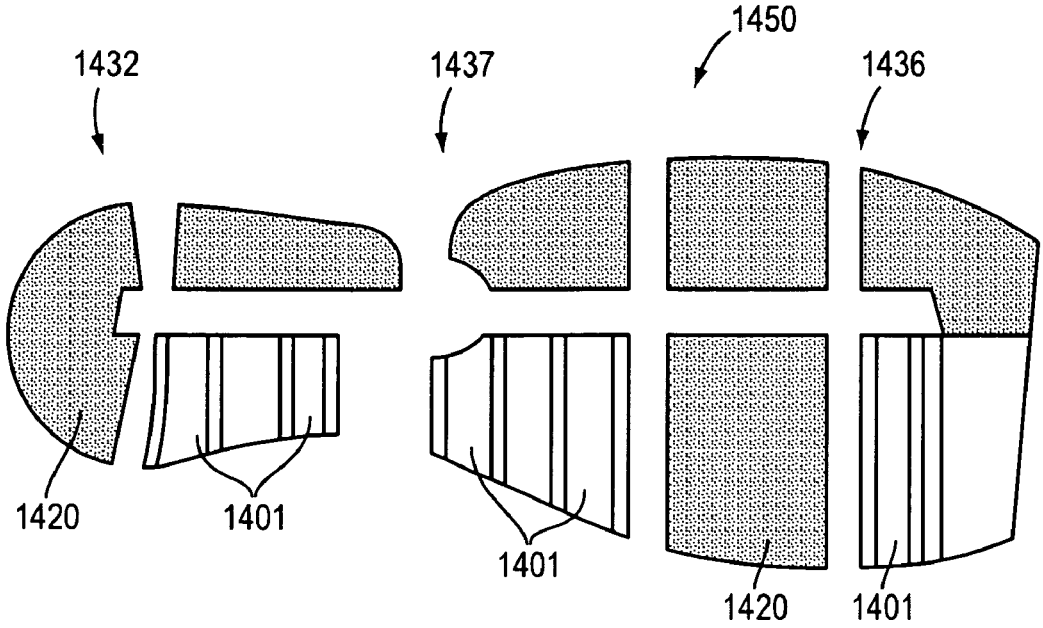
FIG. 22 is an arrangement of first deformation elements and second deformation elements in the shoe sole of FIGS. 20 and 21 in accordance with one embodiment of the invention.

FIG. 22 depicts one distribution of the deformation elements 1401, 1420 in accordance with an embodiment of the invention. In the forefoot region 1436, foamed deformation elements 1420 are arranged in areas of the sole 1450 that correspond to the metatarsal heads of the wearer's foot. This region of the sole 1450 is subjected to a particular load during push-off at the end of the step cycle. Accordingly, in order to avoid localized pressure points on the foot, the second deformation elements 1401 are not arranged in this sole region. In one embodiment, to assist the first deformation element 1420 below the metatarsal heads of the wearer's foot and to assure a correct position of the foot during the pushing-off phase, second deformation elements 1401 are provided fore and aft the metatarsal heads of the wearer's foot. The second deformation elements 1401 protect the first deformation element 1420 against excessive loads. Simultaneously, the second deformation elements 1401 allow for a more purposeful control of the series of movements of the wearer's foot during push off, thereby maintaining the neutral position of the wearer's foot and avoiding supination or pronation.

Referring again to FIG. 21, in one embodiment, providing the load distribution plate 1452 above the deformation elements 1401, 1420 evenly distributes the forces acting on the foot over the full area of the sole 1450 and thereby avoids localized peak loads on the foot. As a result, comfort for the wearer of the article of footwear 1430 is increased. In one embodiment, the mid-foot region 1437 can be reinforced by a light, but highly stable carbon fiber plate 1453, inserted into a corresponding recess 1454 of the load distribution plate 1452.

In one embodiment, a gap 1455 is provided in the outsole 1451 and curved interconnecting ridges 1456 are provided between the heel region 1432 and the forefoot region 1436 of the midsole 1440. The curved interconnecting ridges 1456 reinforce corresponding curvatures 1457 in the outsole 1451. The torsional and bending behavior of the sole 1450 is influenced by the form and length of the gap 1455 in the outsole 1451, as well as by the stiffness of the curved interconnecting ridges 1456 of the midsole 1440. In another embodiment, a specific torsion element is integrated into the sole 1450 to interconnect the heel region 1432 and the forefoot region 1436 of the sole 1450.

In one embodiment, ridges 1458 are arranged in the forefoot region 36 of the outsole 1451. In another embodiment, ridges 1458 are additionally or alternatively arranged in the heel region 1432 of the outsole 1451. The ridges 1458 provide for a secure anchoring of the deformation elements 1401, 1420 in the sole 1450. In one embodiment, as illustrated in FIG. 21, the sole 1450 includes an additional midsole 1460.

Figure 23:
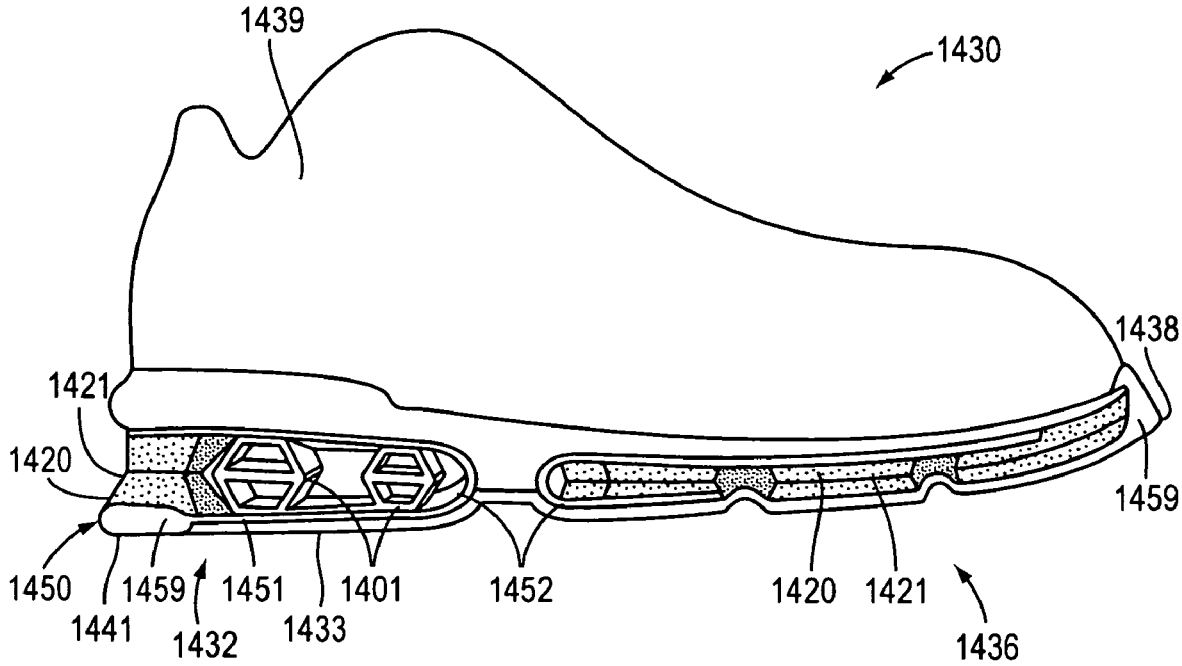
FIG. 23 is a schematic side view of an article of footwear including an alternative embodiment of a shoe sole in accordance with the invention.

FIG. 23 depicts an alternative embodiment of an article of footwear 1430 in accordance with the invention. In the illustrative embodiment shown, the second deformation elements 1401 are exclusively arranged in the front portion 1433 of the heel region 1432 of the sole 1450. In this embodiment, the forefoot region 1436 and the heel region 1432 have separate load distribution plates 1452. Both load distribution plates 1452 are bent in a recumbent U-shaped configuration, when viewed from the side, and encompass at least partially one or more deformation elements 1401, 1420. This structure further increases the stability of the sole 1450. In one embodiment, wear resistant reinforcements 1459 are arranged at a front end 1438 and/or at the rear end 1441 of the outsole 1451.

Providing a U-shaped load distribution plate 1452 is independent of the use of the second deformation elements 1401. In another embodiment, second deformation elements 1401 are only provided in the forefoot region 1436, but, nevertheless, two load distribution plates 1452, as shown in FIG. 23, are provided. In yet another embodiment, second deformation elements 1401 are provided in both the heel region 1432 and in the forefoot region 1436. Additional examples and details of load distribution plates are found in U.S. patent application Ser. Nos. 10/099,859 and 10/391,488, now U.S. Pat. Nos. 6,722,058 and 6,920,705, respectively, the disclosures of which are hereby incorporated herein by reference in their entireties.

Figure 24:
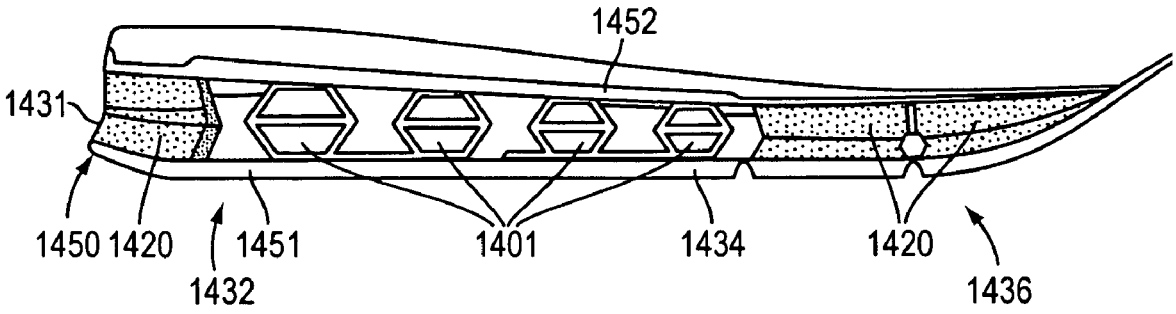
FIG. 24 is a schematic side view of an alternative shoe sole in accordance with the invention.
Figure 25:
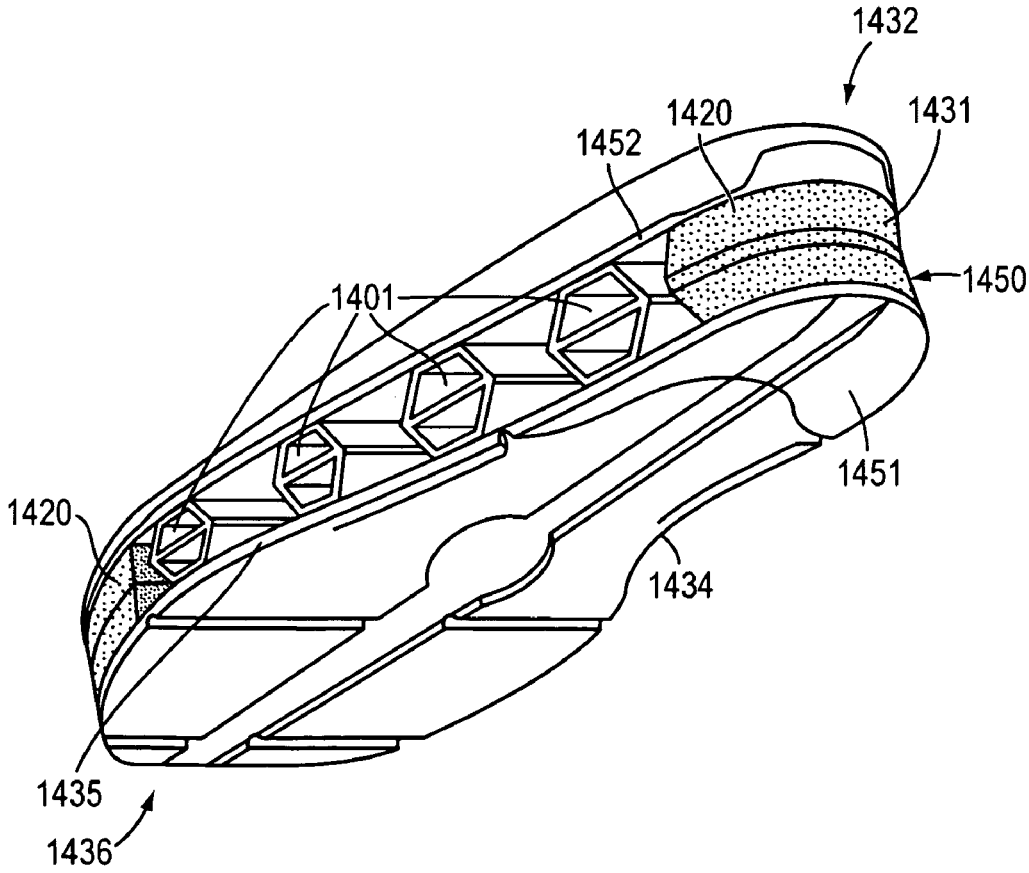
FIG. 25 is a schematic perspective bottom lateral view of the shoe sole of FIG. 24.

In another embodiment, as illustrated in FIGS. 24 and 25, second deformation elements 1401 are provided on the lateral side 1435, as well as on the medial side 1434, of the sole 1450, contrary to the embodiment depicted in FIG. 22. In yet another embodiment, the second deformation elements 1401 are provided only on the lateral side 1435 of the sole 1450. Additionally, a configuration of second deformation elements 1401 extending from the lateral side 1435 to the medial side 1434 may be provided.

Referring still to FIGS. 24 and 25, the load distribution plate 1452 extends along almost the entire length of the shoe sole 1450, i.e., from the heel region 1432 to the forefoot region 1436. The first deformation elements 1420 are provided in the particularly sensitive areas of the shoe sole 1450, i.e., in the aft portion 1431 of the heel region 1432 and approximately below the metatarsal heads of a wearer's foot. The other sole areas are supported by second deformation elements 1401.

Figure 26:
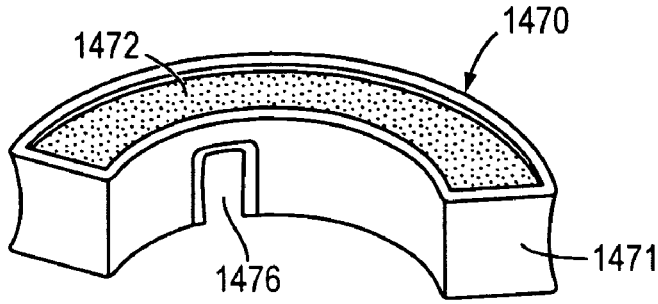
FIG. 26 is a schematic perspective front view of a first deformation element in accordance with one embodiment of the invention.
Figure 27:
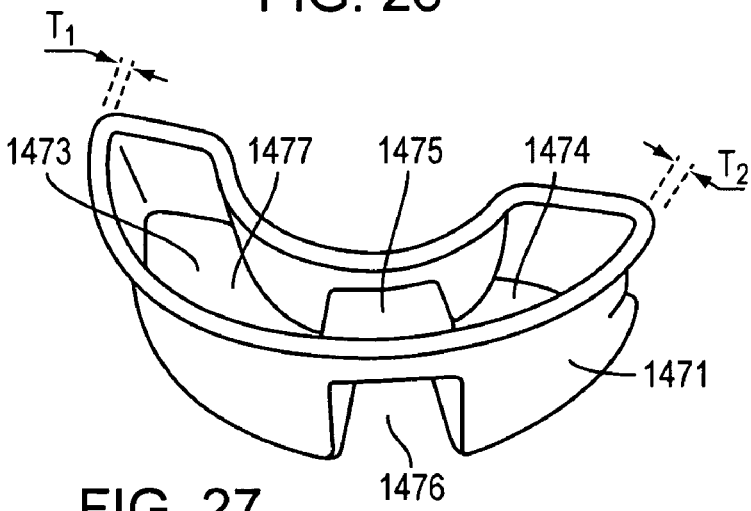
FIG. 27 is a schematic perspective rear view of a shell of the first deformation element of FIG. 26 without any foamed material.

FIGS. 26-27 depict a particular embodiment of a first deformation element 1470 in accordance with the invention. The first deformation element 1470 includes a foamed material 1472. In contrast to the first deformation element 1420 described above, which consists exclusively of foamed material, the first deformation element 1470 is a hybrid structure that includes an outer shell 1471 forming one or more cavities 1477 that are filled with the foamed material 1472. Thus, the superior cushioning properties of the foamed material 1472 are combined with a potentially wide range of adjustment options that may be provided by varying the shape, the material, and the wall thickness of the outer shell 1471. The first deformation element 1470 is illustrated as it is used in the rearmost portion of the heel region 1432. The first deformation element 1470, including the outer shell 1471 and the foamed material 1472, may, however, also be used in other parts of the shoe sole 1450, in a similar manner to the above described first deformation elements 1420.

The outer shell 1471 serves several purposes. First, the outer shell 1471 provides cushioning in a manner similar to the second deformation elements 1401, due to its own elastic deflection under load. In addition, the outer shell 1471 contains the foamed material 1472 arranged therein and prevents the excessive expansion of the foamed material 1472 to the side in the case of peak loads. As a result, premature fatigue and failure of the foamed material 1472 is avoided. Moreover, in a manner similar to the second deformation elements 1401, the cushioning properties of the outer shell 1471 are less temperature dependent than are the cushioning properties of the foamed material 1472 alone. Further, the outer shell 1471, which encapsulates the one or more foamed materials 1472, achieves the desired cushioning properties with a first deformation element 1470 of reduced size. Accordingly, the limited space available on the sole 1450, in particular in the rearfoot portion, can be more effectively used for arranging further functional elements thereon.

As shown in the presentation of the outer shell 1471 in FIG. 27, the first deformation element 1470, in one embodiment, includes a lateral chamber 1473 and a medial chamber 1474. As a result, the cushioning properties for the lateral side 1435, where the first ground contact will typically occur for the majority of athletes, and for the medial side 1434 can be separately designed. For example, in one embodiment, the lateral chamber 1473 is larger than the medial chamber 1474 and is designed to cushion the high ground reaction forces arising during the first ground contact with the heel region 1432. Alternatively, in other embodiments, the medial chamber 1474 is larger than the lateral chamber 1473.

The lateral chamber 1473 and the medial chamber 1474 are, in one embodiment, interconnected by a bridging passage 1475. The bridging passage 1475 may also be filled with the foamed material 1472. Due to the improved cushioning properties of the first deformation element 1470, it is not necessary to cover the entire rearfoot portion with the first deformation element 1470 and an open recess 76 may be arranged below the bridging passage 1475. The recess 1476 may be used to receive further functional elements of the shoe sole 1450. Additionally, the recess 1476 allows for a more independent deflection of the lateral chamber 1473 and the medial chamber 1474 of the first deformation element 1470.

Both the outer shell 1471 and the foam material 1472 determine the elastic properties of the first deformation element 1470. Accordingly, the first deformation element 1470 provides several possibilities for modifying its elastic properties. Gradually changing the wall thickness of the outer shell 1471 from the medial (T2) to the lateral (T1) side, for example, will lead to a gradual change in the hardness values of the first deformation element 1470. This may be achieved without having to provide a foamed material 1472 with a varying density. As another example, reinforcing structures inside the lateral chamber 1473 and/or the medial chamber 1474, which may be similar to the tension element 1403 of the second deformation element 1401, allow for selective strengthening of specific sections of the first deformation element 1470. As a further means for modifying the elastic properties of the first deformation element 1470, foamed materials 1472 of different densities may be used in the lateral chamber 1473 and the medial chamber 1474 of the first deformation element 1470, or, in alternative embodiments, in further cavities of the first deformation element 1470.

Figure 28A:
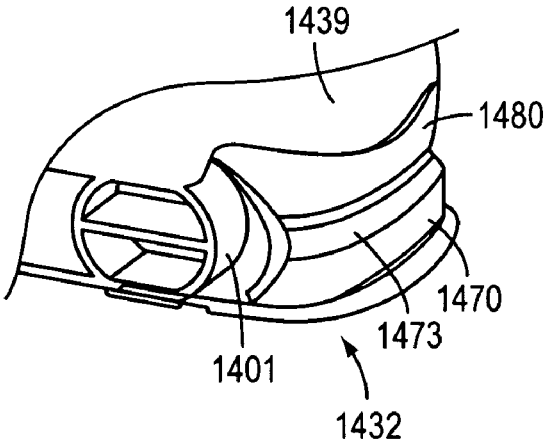
FIG. 28A is a schematic lateral side view of the rearmost portion of a shoe sole including the first deformation element of FIGS. 26 and 27.
Figure 28B:
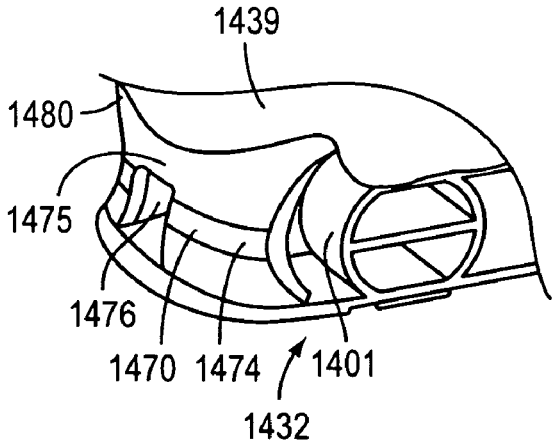
FIG. 28B is a schematic medial side view of the rearmost portion of a shoe sole including the first deformation element of FIGS. 26 and 27.

FIGS. 28A-28B depict one embodiment of an arrangement of the first deformation element 1470 in the rearmost portion of the heel region 1432 of the shoe sole 1450 in accordance with the invention. As in the embodiments that use the first deformation element 1420, discussed above, a second deformation element 1401 is arranged next to the first deformation element 1470 and provides additional support immediately after the cushioning of the heel strike. In one embodiment, as depicted in FIGS. 28A and 28B, an upwardly directed projection 1480 of the first deformation element 1470 is arranged on top of the bridging passage 1475. The projection 1480 facilitates a reliable bonding of the first deformation element 1470 to the rest of the shoe sole 1450 and to the upper 1439 of the article of footwear 1430.

In one embodiment, the outer shell 1471 is made from a thermoplastic material, such as, for example, a thermoplastic urethane (TPU). TPU can be easily three-dimensionally formed at low costs by, for example, injection molding. Moreover, an outer shell 1471 made from TPU is not only more durable than a standard foam element, but, in addition, its elastic properties are less temperature dependent than a standard foam element and thereby lead to more consistent cushioning properties for the article of footwear 1430 under changing conditions. The thermoplastic material may have an Asker C hardness of about 65.

The foamed material 1472 is, in one embodiment, a polyurethane (PU) foam. The foamed material 1472 may be prefabricated and subsequently inserted into the outer shell 1471, or, alternatively, cured inside the cavity 1477 of the outer shell 1471. In one embodiment, the foamed material 1472 is a PU foam having a Shore A hardness of about 58 and exhibits about 45% rebound.

Having described certain embodiments of the invention, it will be apparent to those of ordinary skill in the art that other embodiments incorporating the concepts disclosed herein may be used without departing from the spirit and scope of the invention, as there is a wide variety of further combinations of a heel cup, side walls, tension elements, reinforcing elements and ground surfaces that are possible to suit a particular application and may be included in any particular embodiment of a heel part and shoe sole in accordance with the invention. The described embodiments are to be considered in all respects as only illustrative and not restrictive.

What is claimed is:

1. A sole for an article of footwear, the sole comprising:

a first area including a first deformation element comprising a foamed material; and a second area including a plurality of second deformation elements disposed with the first area within a common layer of the sole, each of the second deformation elements comprising an open-walled structure free from foamed materials, wherein each of the second deformation element further comprises at least two side walls and at least one element interconnecting center regions of inside surfaces of the side walls.

2. The sole of claim 1, wherein each side wall comprises a single integral piece.

3. The sole of claim 1, wherein the at least one element interconnecting the center regions of the side walls is placed in tension upon compressive loading of the sole.

4. The sole of claim 3, wherein the side walls and the interconnecting element comprise a single piece.

5. The sole of claim 4, wherein the single piece comprises a thermoplastic material.

6. The sole of claim 5, wherein the thermoplastic material has a hardness between about 70 Shore A and about 85 Shore A.

7. The sole of claim 5, wherein the thermoplastic material has a hardness between about 75 Shore A and about 80 Shore A.

8. The sole of claim 1, wherein a thickness of at least one of the interconnecting element and the side walls increases along a length of the second deformation element.

9. The sole of claim 1, wherein the side walls are further interconnected by at least one of an upper side and a lower side.

10. The sole of claim 1 wherein the plurality of second deformation elements comprises two second deformation elements arranged adjacent each other.

11. The sole of claim 10, wherein at least one of an upper side and a lower side interconnects adjacent side walls of the two second deformation elements.

12. The sole of claim 11, wherein the two second deformation elements are further interconnected by at least one of an upper connecting surface and a lower connecting surface.

13. The sole of claim 1, wherein the first area is arranged in an aft portion of a heel region of the sole.

14. The sole of claim 1, wherein the second area is arranged in a front portion of a heel region of the sole.

15. The sole of claim 1, wherein the first area is arranged to correspond to metatarsal heads of a wearer's foot.

16. The sole of claim 15, wherein the second area is arranged fore of the metatarsal heads of the wearer's foot.

17. The sole of claim 15, wherein the second area is arranged aft of the metatarsal heads of the wearer's foot.

18. The sole of claim 1, wherein the first deformation element and the second deformation element are arranged below at least a portion of at least one load distribution plate of the sole.

19. The sole of claim 18, wherein the load distribution plate at least partially three-dimensionally encompasses at least one of the first deformation element and the second deformation element.

20. An article of footwear comprising an upper and a sole, the sole comprising:

a first area including a first deformation element comprising a foamed material; and a second area including a plurality of second deformation elements disposed with the first area within a common layer of the sole, each of the second deformation elements comprising an open-walled structure free from foamed materials, wherein each of the second deformation element further comprises at least two side walls and at least one element interconnecting center regions of inside surfaces of the side walls.

* * * * *